US009146515B2

(12) United States Patent
Uchino et al.

(10) Patent No.: US 9,146,515 B2
(45) Date of Patent: Sep. 29, 2015

(54) IMAGE FORMING APPARATUS

(71) Applicant: CANON KABUSHIKI KAISHA, Tokyo (JP)

(72) Inventors: Megumi Uchino, Tokyo (JP); Yoshihiro Shigemura, Yokohama (JP); Shingo Horita, Yokosuka (JP); Masaaki Naoi, Yokosuka (JP); Mineto Yagyu, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/252,933

(22) Filed: Apr. 15, 2014

(65) Prior Publication Data

US 2014/0314432 A1 Oct. 23, 2014

(30) Foreign Application Priority Data

Apr. 22, 2013 (JP) ..... 2013-089618

(51) Int. Cl.
*G03G 15/02* (2006.01)
*G03G 15/00* (2006.01)
*G03G 15/08* (2006.01)

(52) U.S. Cl.
CPC ..... *G03G 15/50* (2013.01); *G03G 15/0848* (2013.01)

(58) Field of Classification Search
CPC ..... G03G 15/50; G03G 5/0848; G03G 2215/00071; G03G 15/5041
USPC ..... 399/51
See application file for complete search history.

(56) References Cited

U.S. PATENT DOCUMENTS 5,006,897 A 4/1991 Rimai et al.

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

In an image forming apparatus, in the case where a time necessary for a developer bearing member to rotate from a measurement position where an attracting unit attracts the toner on the developer bearing member to a developing position at which an electrostatic latent image on the photosensitive member is developed by a toner on the developer bearing member is represented by a time Tqcm, a time necessary for the photosensitive member to rotate from an exposure position at which an exposure unit exposes the photosensitive member to the developing position is represented by a time Tetd, and a time necessary for a control unit to control an exposing condition based on a charge amount measured by a measuring unit is represented by a time Tp, the attracting unit is disposed so that Tqcm≥Tedt+Tp holds true.

10 Claims, 19 Drawing Sheets

IMAGE FORMING APPARATUS

BACKGROUND OF THE INVENTION

1. Field of the Invention

The present invention relates to image forming apparatuses that control image forming conditions based on a result of detecting a charge amount of toner.

2. Description of the Related Art

An electrophotographic image forming apparatus forms an electrostatic latent image upon a photosensitive member based on an image of a document read by a reader, transferred from an external PC, or the like, and forms a toner image by developing the electrostatic latent image on the photosensitive member using toner in a developer. The image forming apparatus controls the density of the toner image by controlling image forming conditions such as an exposure amount of laser light emitted from an exposure apparatus for forming the electrostatic latent image on the photosensitive member, a developing bias for developing the electrostatic latent image on the photosensitive member, a charging potential for charging the photosensitive member, and so on. However, a charge amount of the toner in the developer changes when the toner in the developer is consumed and the developer is refilled with new toner during the formation of many toner images. The charge amount of the toner in the developer also changes in response to changes in the temperature, humidity, and so on within the developer. It is desirable to control the image forming conditions in accordance with the charge amount of the toner in the developer in order to control the density, color, and so on of the toner image in a precise manner.

U.S. Pat. No. 5,006,897 discloses an apparatus including a probe that recovers a small amount of toner from a magnetic brush roller in a developer and measures a charge amount of the toner in the developer based on a mass of the toner recovered by the probe and a change in the amount of electric charge on the magnetic brush roller. According to U.S. Pat. No. 5,006,897, first, the probe, which includes a piezoelectric crystal resonator and an electrode, is caused to attract toner located upon the magnetic brush roller of the developer, and the piezoelectric crystal resonator is then caused to vibrate. A mass M of the toner that adheres to the probe is then calculated based on a difference between a vibration frequency when the toner adheres to the probe and a vibration frequency when no toner adheres to the probe. Furthermore, because toner moves from the magnetic brush roller to the probe, an amount of electric charge Q of the toner adhering to the probe can be found by measuring a change in the amount of electric charge on the magnetic brush roller. The charge amount of the toner in the developer can then be detected based on the mass M and the amount of electric charge Q of the toner adhering to the probe.

However, according to U.S. Pat. No. 5,006,897, the probe is caused to attract toner remaining on the magnetic brush roller after the electrostatic latent image on the photosensitive member has been developed (called "residual toner" hereinafter), and the charge amount of the residual toner is then detected. In other words, according to U.S. Pat. No. 5,006,897, the charge amount of the toner adhering to the photosensitive member is different from the charge amount of the residual toner detected by the probe, and thus there is a problem in that the image forming conditions for forming a toner image at a desired density cannot be set in a precise manner. According to U.S. Pat. No. 5,006,897, even if, for example, the charge amount of the toner has changed drastically, the toner image will be formed based on image forming conditions set before the change in the charge amount of the toner. It is further possible that the charge amount of the residual toner on the magnetic brush roller after the toner has been caused to adhere to the electrostatic latent image on the photosensitive member will have a different value than the charge amount of the toner caused to adhere to the photosensitive member.

FIG. 4 illustrates differences in the amounts of toner adhering to an electrostatic latent image upon a photosensitive member in the case where there are different charge amounts for the toner. The following will describe a case in which the image forming conditions are set based on the charge amount of the toner detected at a predetermined timing. Accordingly, in the following descriptions, a target value for the charge amount is equal to the charge amount of the toner detected at a predetermined timing. Furthermore, in the following descriptions, the amount of toner adhering to the electrostatic latent image on the photosensitive member in the case where the charge amount of the toner is the target value corresponds to a target amount of the toner, at which an image can be formed at a desired density. In the case where the charge amount of the toner used for developing is greater than the target value, the amount of toner adhering to the electrostatic latent image on the photosensitive member will be lower than the target amount. An image that is lighter than the desired density will be formed as a result. On the other hand, in the case where the charge amount of the toner used for developing is lower than the target value, the amount of toner adhering to the electrostatic latent image on the photosensitive member will be greater than the target amount. An image that is darker than the desired density will be formed as a result. Note that in FIG. 4, the vertical axis represents a surface potential of the photosensitive member, Vl represents a light potential (a potential at a region of the photosensitive member that has been exposed), Vcont represents a developing contrast potential difference, Vdev represents a developing bias, Vd represents a dark potential (a potential at a region of the photosensitive member that has not been exposed), and Vback represents a potential difference between the dark potential and the developing bias.

SUMMARY OF THE INVENTION

Accordingly, the present invention provides an image forming apparatus capable of controlling the density of a toner image in a highly-precise manner based on a charge amount of toner in a developer.

According to one aspect of the present invention, there is provided an image forming apparatus comprising: a photosensitive member configured to rotate; an exposure unit configured to expose the photosensitive member to form an electrostatic latent image on the photosensitive member; a developing unit, including a developer bearing member configured to bear toner and rotate, configured to develop the electrostatic latent image on the photosensitive member using the toner borne by the developer bearing member; a measuring unit, including an attracting unit configured to attract the toner on the developer bearing member, configured to measure a charge amount of the toner attracted to the attracting unit; and a control unit configured to control an exposing condition of the exposure unit, based on the charge amount measured by the measuring unit, wherein in the case where a time necessary for the developer bearing member to rotate from a measurement position where the attracting unit attracts the toner on the developer bearing member to a developing position at which the electrostatic latent image on the photosensitive member is developed by the toner on the developer bearing member is represented by a time Tqcm, a time necessary for the photosensitive member to rotate from an exposure position at which the exposure unit exposes the photosensitive member to the developing position is represented by a time Tetd, and a time necessary for the control unit to control the exposing condition based on the charge amount measured by the measuring unit is represented by a time Tp, the attracting unit is disposed so that Tqcm≥Tedt+Tp holds true.

According to the present invention, the density of a toner image can be controlled in a highly precise manner based on a charge amount of toner in a developer.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the appended drawings. The present invention is applicable specifically in image forming apparatuses such as various types of printers, copiers, and multifunction peripherals; constituent elements aside from units and sequences related to the measurement and control of a toner charge amount, which is central to the present invention and will be described later, may be the same as those in conventional image forming apparatuses.

First Embodiment

Apparatus Configuration

Figure 1:
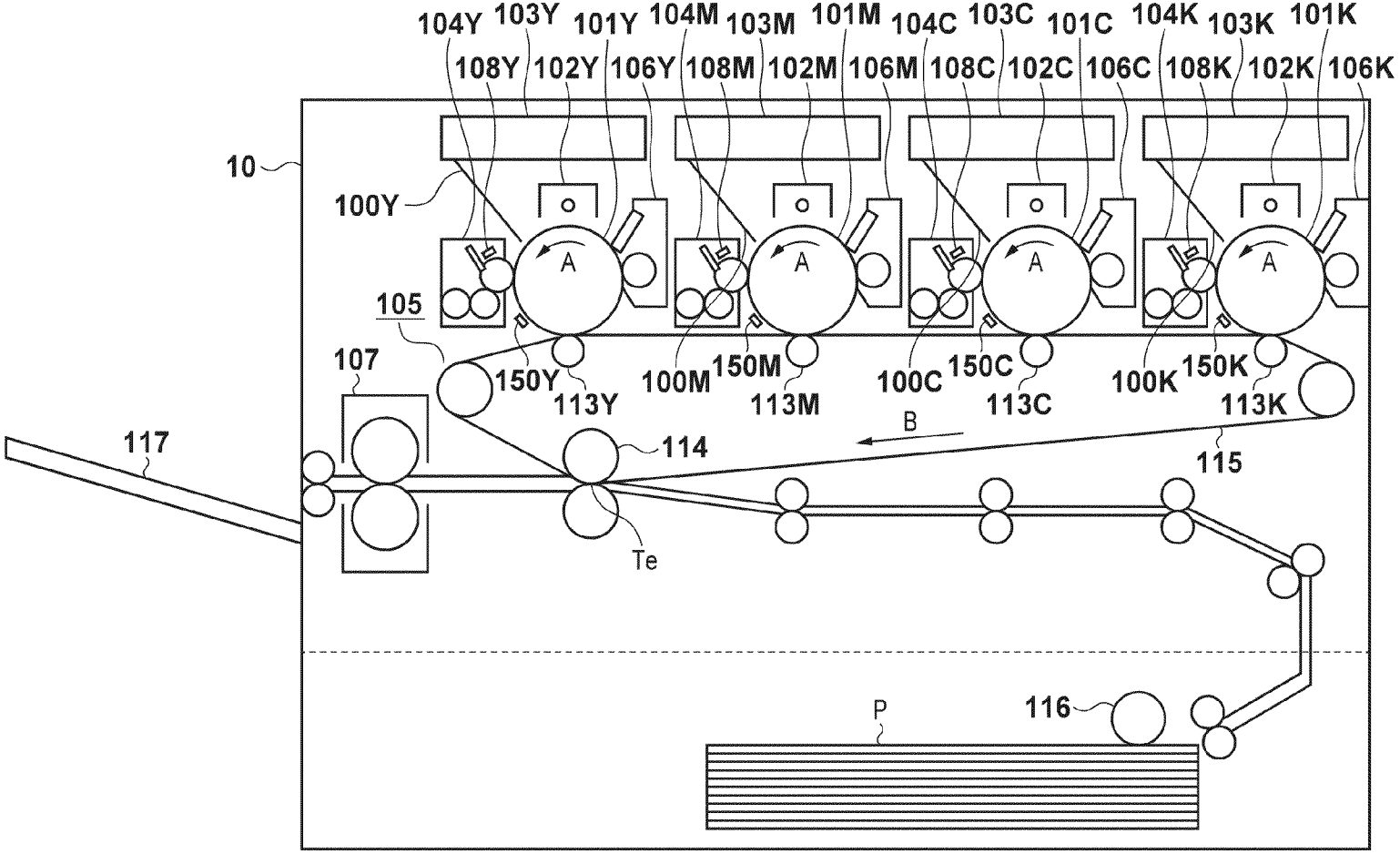
FIG. 1 is a diagram illustrating an overview of the configuration of an image forming apparatus.

FIG. 1 is a diagram illustrating the overall configuration of an electrophotographic image forming apparatus.

Charging apparatuses 102Y, 102M, 102C, and 102K, laser scanners 103Y, 103M, 103C, and 103K, developing apparatuses 104Y, 104M, 104C, and 104K, and drum cleaners 106Y, 106M, 106C, and 106K are arranged in the periphery of photosensitive drums 101Y, 101M, 101C, and 101K, respectively. Images of respective color components are formed upon the photosensitive drums 101Y, 101M, 101C, and 101K in an image forming process, which will be described later. Here, a yellow image is formed upon the photosensitive drum 101Y, a magenta image is formed upon the photosensitive drum 101M, a cyan image is formed upon the photosensitive drum 101C, and a black image is formed upon the photosensitive drum 101K. Meanwhile, primary transfer rollers 113Y, 113M, 113C, and 113K transfer the respective color component images onto an intermediate transfer belt 115 so that the images of the respective color components formed upon the photosensitive drums 101Y, 101M, 101C, and 101K are superimposed on the intermediate transfer belt 115. Here, the configurations of the photosensitive drums 101Y, 101M, 101C, and 101K, the charging apparatuses 102Y, 102M, 102C, and 102K, the laser scanners 103Y, 103M, 103C, and 103K, the developing apparatuses 104Y, 104M, 104C, and 104K, the drum cleaners 106Y, 106M, 106C, and 106K, and the primary transfer rollers 113Y, 113M, 113C, and 113K are the same, and thus the letters Y, M, C and K will be omitted in the following descriptions.

The photosensitive drum 101 includes a photosensitive member having a photosensitive layer on its surface, and is rotationally driven in the direction of an arrow A. When a print start signal is input, the photosensitive drum 101 begins rotating in the direction of the arrow A, and the charging apparatus 102 charges the surface of the photosensitive drum 101 to a predetermined potential. Then, an electrostatic latent image is formed upon the photosensitive drum 101 by the laser scanner 103 irradiating the photosensitive drum 101 with laser light 100 based on an image signal expressing an image to be printed. The developing apparatus 104 holds a developing material having toner and a carrier. The developing apparatus 104 develops the electrostatic latent image formed on the photosensitive drum 101 using the toner in the developing material. The image upon the photosensitive drum 101 (that is, a toner image) is, as a result of the photosensitive drum rotating in the direction of the arrow A, conveyed to a primary transfer nip area where the intermediate transfer belt 115 and the photosensitive drum 101 make contact with each other. A transfer voltage is applied to the toner image formed on the photosensitive drum 101 via a primary transfer roller 113, and the toner image is transferred onto the intermediate transfer belt 115 as a result.

The intermediate transfer belt 115 is rotationally driven in the direction of an arrow B. When the respective color component toner images are transferred in a superimposed manner from the respective photosensitive drums 101, a full-color toner image is formed on the intermediate transfer belt 115. Toner that is not transferred from the photosensitive drum 101 to the intermediate transfer belt 115 and remains on the photosensitive drum 101 is removed by the drum cleaner 106.

The toner image on the intermediate transfer belt 115 is conveyed to a secondary transfer nip area Te as a result of the rotation of the intermediate transfer belt 115. At this time, recording medium P held in a paper feed cassette is separated one sheet at a time by a paper feed roller 116, and is conveyed to the secondary transfer nip area Te by adjusting the timing so that the toner image on the intermediate transfer belt 115 and the recording medium P make contact with each other.

In the present embodiment, a measurement process and an adjustment process are executed in parallel with the aforementioned image forming process. The measurement process is a process for measuring a mass M and an amount of electric charge Q of the toner immediately before development on the photosensitive drum 101, performed by a charge amount measurement unit 108 provided within the developing apparatus 104. The adjustment process is a process for controlling an amount of the laser light 100 emitted by the laser scanner 103 in order to form an image having a desired density, based on the mass M and the amount of electric charge Q of the toner measured in the measurement process.

Configuration of QCM Sensor

Figure 2A:
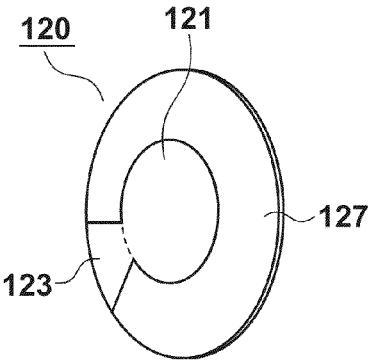
FIGS. 2A and 2B are diagrams illustrating an overview of the configuration of a QCM sensor.
Figure 2B:
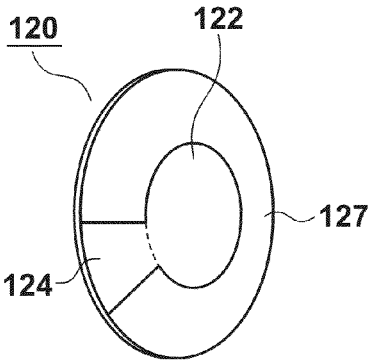

The configuration of a QCM sensor that is used in the present embodiment to measure the mass of the toner will be described using FIGS. 2A and 2B. FIGS. 2A and 2B are perspective views taken from two electrodes provided in the sensor. A QCM sensor 120 is configured of a toner attracting surface 121, a toner non-attracting surface 122, an electrode 123, an electrode 124, and a quartz chip 127 (a quartz oscillator). The toner attracting surface 121 corresponds to a first electrode provided on one surface (a first surface) of the quartz chip 127 (the quartz oscillator), whereas the toner non-attracting surface 122 corresponds to a second electrode provided on the other (opposite) surface (a second surface) of the quartz chip 127 (the quartz oscillator). The principles of measurement performed by the QCM sensor 120 are described in detail in, for example, Japanese Patent No. 3,725,195, and thus only an overview will be given here.

The QCM sensor 120 used in the present embodiment employs a property in which when a voltage is applied to a thin sheet of quartz, crystal vibrations are produced by a reverse piezoelectric effect of the quartz. In other words, the QCM sensor 120 detects the amount of toner adhering to the toner attracting surface 121, which serves as an attracting unit, based on an amount by which a resonance frequency of the quartz chip 127 (the quartz oscillator) drops.

Generally speaking, the relationship between a change in mass ΔM of attracted objects and a change in resonance frequency Δf in a QCM device employing a quartz oscillator is known to be expressed by Sauerbrey's equation, indicated by the following Formula (1).

$$\Delta f = -\frac{2 \times f_0^2}{\sqrt{\rho \times \mu}} \times \frac{\Delta M}{B} \tag{1}$$

Here, $f_0$ represents the resonance frequency of the oscillator, ρ represents the density of the quartz ($2.649\times10^3$ kg/m$^3$), μ represents the shearing stress of the quartz ($2.947\times10^{10}$ kg/ms$^2$), and B represents the active vibrating surface area (approximate electrode surface area).

For example, in the case where the resonance frequency $f_0$ of the quartz chip 127 is 10 MHz and the change amount Δf in the resonance frequency when toner adheres to the toner attracting surface 121 is 1 Hz, approximately 5 ng/cm$^2$ of toner will adhere to the toner attracting surface 121.

In FIG. 2A, the toner attracting surface 121 and the electrode 123 are electrically connected seamlessly. Likewise, in FIG. 2B, the toner non-attracting surface 122 and the electrode 124 are electrically connected seamlessly. Note that the surfaces of the electrodes 123 and 124 are covered with an insulating material so as not to be affected by electrical disturbance components.

Configuration of Developing Apparatus

Figure 3:
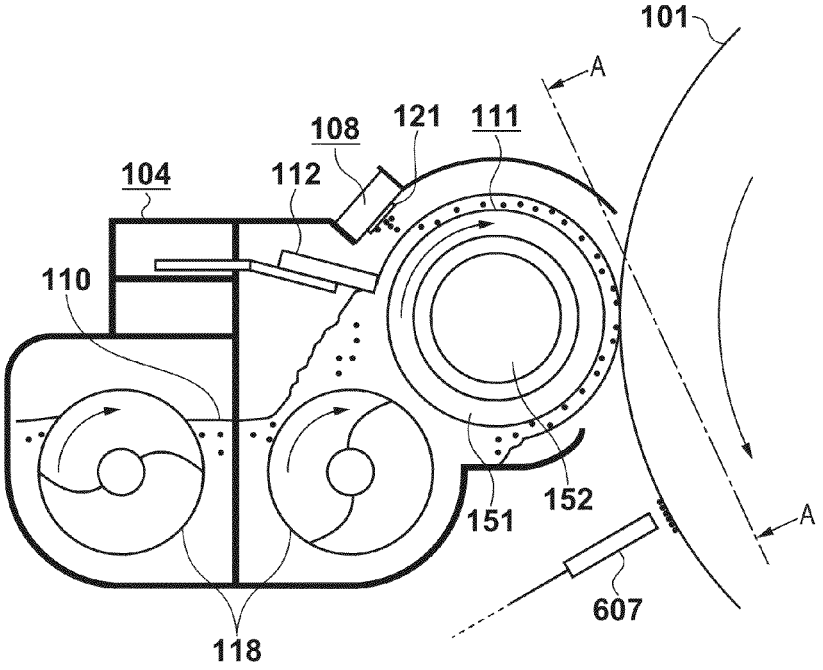
FIG. 3 is a cross-sectional view illustrating the primary components of a developing apparatus according to a first embodiment.
Figure 4:
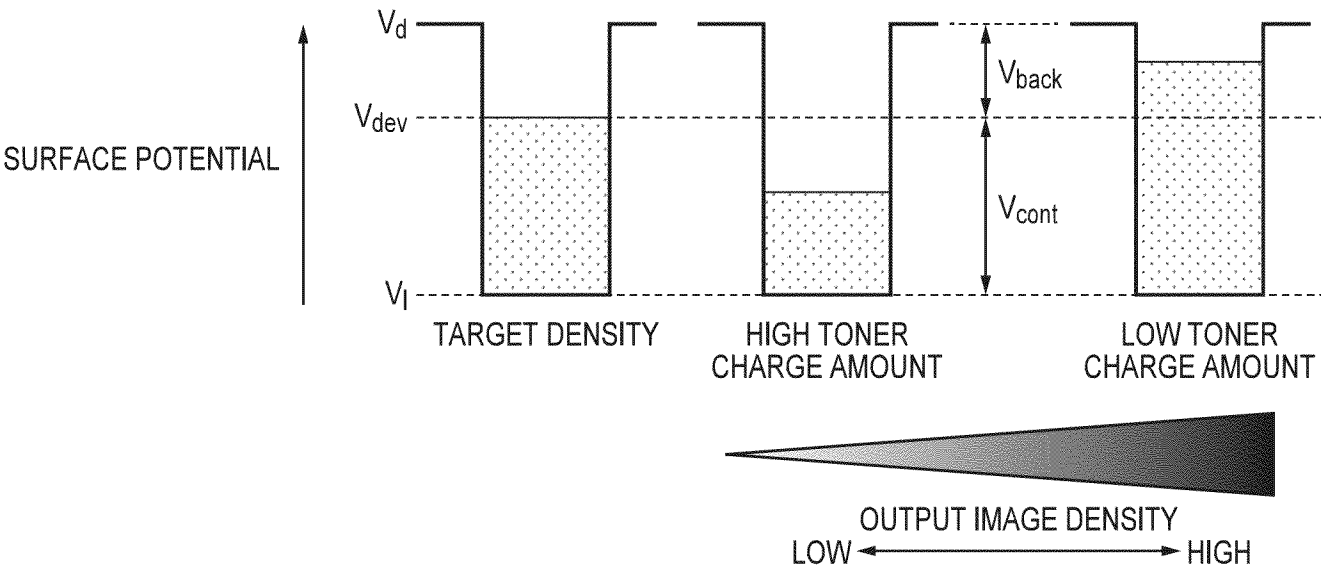
FIG. 4 is a diagram illustrating differences in amounts of toner adhering to an electrostatic latent image on a photosensitive member.

FIG. 3 is a cross-sectional view illustrating the primary components of the developing apparatus 104.

A developing material 110 is primarily configured of two components, namely the toner and the carrier. An agitating screw 118 conveys the developing material 110 in the developing apparatus 104 to a developing sleeve 111 while frictionally electrifying the toner and the carrier within the developing material 110. The developing sleeve 111 includes a nonmagnetic cylinder member 151 capable of rotation and a magnet 152 exhibiting magnetism. The magnet 152 is housed within the cylinder member 151.

The magnetism of the magnet 152 housed within the developing sleeve 111 pulls the developing material 110 to the surface. Furthermore, the developing sleeve 111 conveys the developing material 110 downstream in a rotation direction indicated by an arrow as a result of the cylinder member 151 rotating. A regulation blade 112 serves as a regulation portion that regulates the amount of the developing material 110 conveyed by the developing sleeve 111. The developing material 110 borne by the developing sleeve 111 passes through a small, constant gap formed between the developing sleeve 111 and the regulation blade 112. The amount of toner borne on the developing sleeve 111 is regulated as a result. In addition, when the developing material 110 passes through the small gap, friction is produced between the toner and carrier and the regulation blade 112, increasing the charge amount of the toner as a result.

The charge amount measurement unit 108 is configured to house the QCM sensor 120 so that the toner within the developing apparatus 104 does not adhere to the toner non-attracting surface 122 of the QCM sensor 120. The charge amount measurement unit 108 is disposed downstream from the regulation blade 112 in the rotation direction of the developing sleeve 111. Furthermore, the charge amount measurement unit 108 is disposed so that the toner attracting surface 121 does not make contact with the developing material 110 upon the developing sleeve 111. In the present embodiment, a distance between the toner attracting surface 121 and the developing sleeve 111 is several mm or less, for example.

Figure 6:
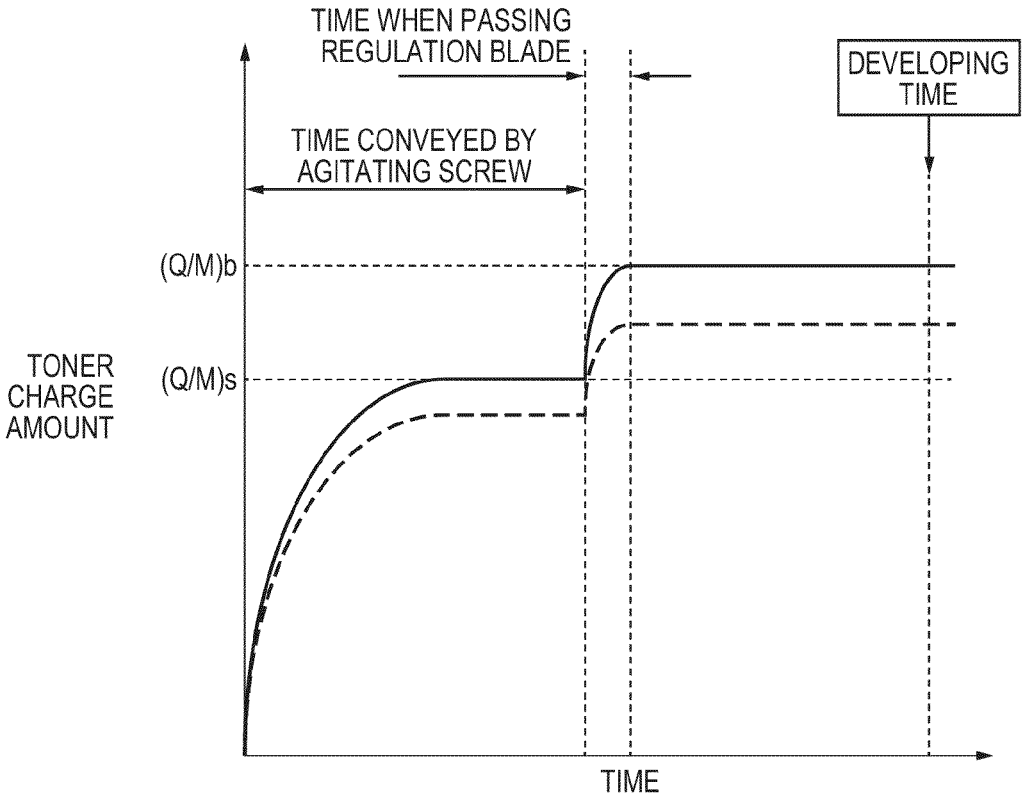
FIG. 6 is a diagram illustrating a charge amount of toner in the developing apparatus.

FIG. 6 is a diagram illustrating a change in the charge amount of the toner within the developing apparatus 104. In FIG. 6, the horizontal axis represents time, and the vertical axis represents the charge amount of the toner. Note that a solid line indicates a change in the charge amount of the toner having desired charge properties, whereas a broken line indicates a change in the charge amount of the toner having charge properties that are lower than the desired charge properties. Upon being agitated by the agitating screw 118, the toner supplied to the developing apparatus 104 is charged to a predetermined value $(Q/M)_s$ as a result of friction between toner molecules. Then, when the toner supply to the developing sleeve 111 traverses the regulation blade 112, the toner is further charged, and the charge amount of the toner on the developing sleeve 111 rises to a target value $(Q/M)_b$. Note that this "target value" corresponds to a theoretical value of the charge amount of the toner on the developing sleeve 111 in the case where the toner within the developing apparatus 104 has the desired charge properties.

On the other hand, the charge amount of the toner that has the charge properties that are lower than the desired charge properties does not increase to the target value $(Q/M)_b$ even if the toner supplied to the developing sleeve 111 traverses the regulation blade 112. In other words, in the case where the toner does not have the desired charge properties, the amount of toner on the developing sleeve 111 that adheres to the electrostatic latent image will change, and thus the density, color, and so on of a toner image developed using that toner will not be a desired density, color, and so on.

The temperature, humidity, and so on in the installation environment of the image forming apparatus, deterioration over time in the carrier due to long-term use, fluctuations in the amount of toner consumed and refilled, and so on can be given as examples of factors that cause fluctuations in the charge properties of the toner within the developing apparatus 104, or in other words, examples of factors that cause fluctuations in the charge amount of the toner. The charge amount of the toner within the image forming apparatus also drops in the case where the developing material is left for long periods of time without being used. Accordingly, the charge amount changes drastically from when the agitation of the developing material within the developing apparatus 104 is restarted to when the charge amount of the toner within the developing apparatus 104 stabilizes.

In the case where the electrostatic latent image is developed using a toner whose charge amount is lower than the target value $(Q/M)_b$, the electrostatic adhesive force of the toner is lower than a desired adhesive force, and thus the amount of toner adhering to the photosensitive drum will increase, resulting in a darker output image. Conversely, in the case where the electrostatic latent image is developed using a toner whose charge amount is higher than the target value $(Q/M)_b$, the electrostatic adhesive force of the toner is higher than the desired adhesive force, and thus the amount of toner adhering to the photosensitive drum will decrease, resulting in a lighter output image. Note that the "desired adhesive force" is a force with which the toner electrostatically adheres to the photosensitive drum in the case where the charge amount of the toner is the target value $(Q/M)_b$.

In the present embodiment, even if the charge amount of the toner has fluctuated, image forming conditions (exposing conditions) at which a toner image having a desired density can be formed are controlled based on a result of measuring the charge amount of the developed toner. In the present embodiment, a pulse timing of the laser light is adjusted in order to control the amount of laser light emitted from the laser scanner. Specifically, the pulsewidth of the signal for driving the laser light when forming the latent image on the photosensitive drum is modulated. As a result, a surface potential on the photosensitive drum is adjusted, and thus the amount of developing toner can be controlled in accordance with the charge amount of the toner. In other words, the density of the toner image can be adjusted to the desired density.

Next, a method for measuring a charge amount Q/M of the toner will be described.

Figure 5:
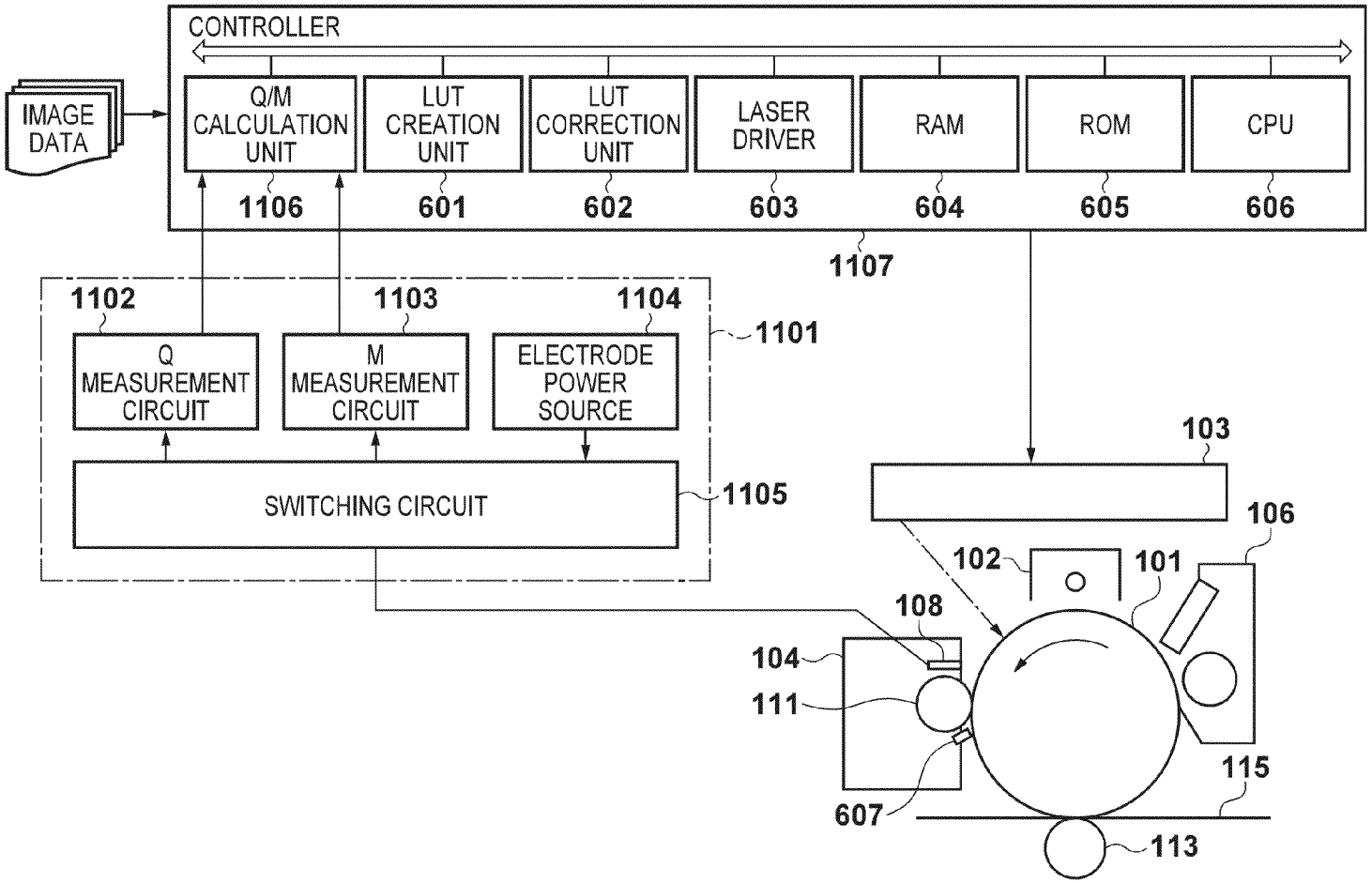
FIG. 5 is a control block diagram illustrating an image forming station according to the first embodiment.

FIG. 5 is a control block diagram illustrating the configuration of an image forming station, which includes the photosensitive drum 101, the charging apparatus 102, the laser scanner 103, the developing apparatus 104, the drum cleaner 106, and the primary transfer roller 113. Note that in FIG. 5, the photosensitive drum 101, the charging apparatus 102, the laser scanner 103, the developing apparatus 104, the drum cleaner 106, and the primary transfer roller 113 are shown in order to simplify the descriptions.

A Q/M measuring unit 1101 includes a Q measuring circuit 1102, an M measuring circuit 1103, an electrode power source 1104, and a switching circuit 1105. The Q/M measuring unit 1101 causes the toner attracting surface 121 to attract the toner on the developing sleeve 111, measures the mass M of the toner attracted to the toner attracting surface 121, and measures the amount of electric charge Q of the toner adhering to the toner attracting surface 121. The circuit configuration of the Q/M measuring unit 1101 will be described later under the section "Detailed Description of Q/M Measuring Unit". Meanwhile, a controller 1107 includes a Q/M calculation unit 1106, an LUT creation unit 601 that creates a γLUT (lookup table), an LUT correction unit 602 that corrects the γLUT, a laser driver 603 that generates and outputs a laser driving signal for controlling the laser scanner, a RAM 604, a ROM 605, and a CPU 606. Note that an image forming apparatus 10 may include other units as well. Handling of the γLUT will be described later.

Figure 7:
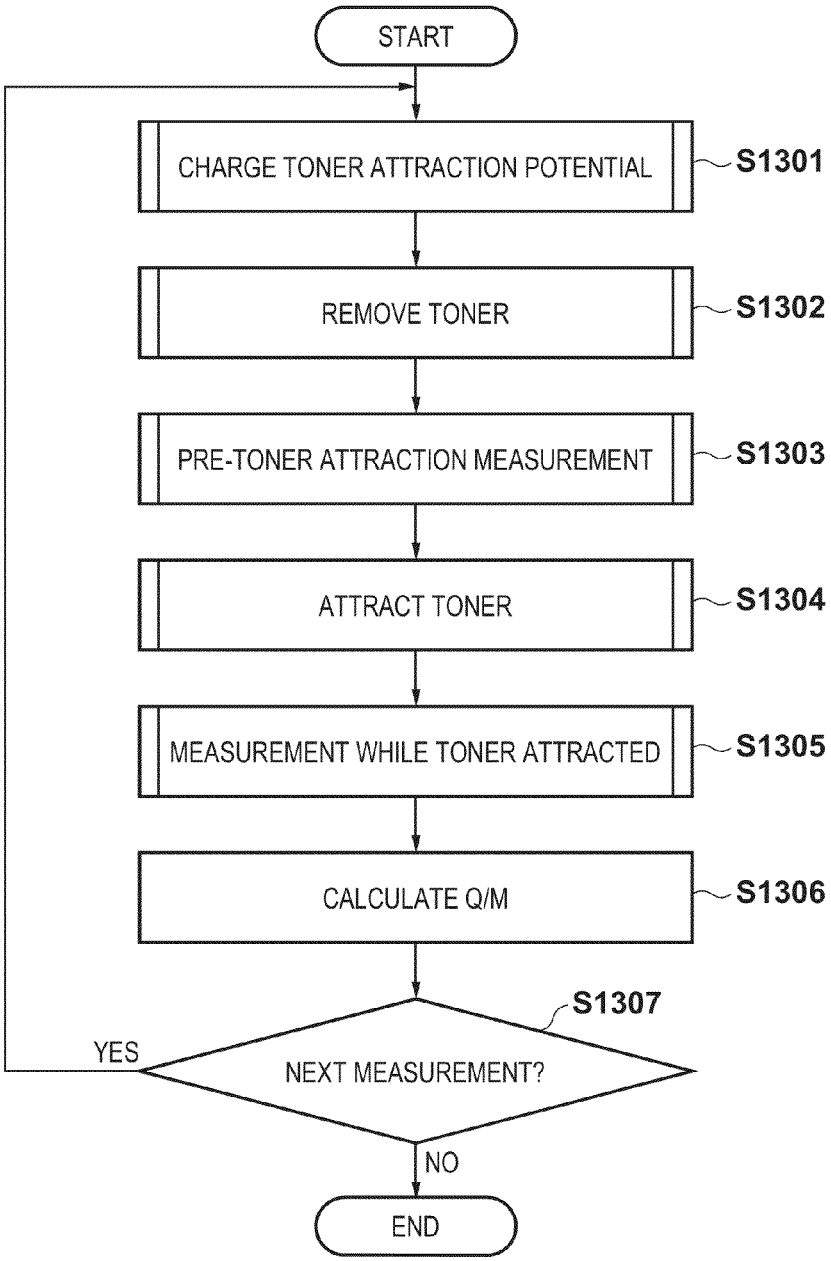
FIG. 7 is a flowchart illustrating a toner charge amount measurement sequence.

Next, a toner charge amount measurement sequence will be described using FIG. 7. In the present embodiment, the CPU 606 detects the charge amount Q/M of the toner on the developing sleeve 111 while an image is being formed based on image data and while a patch image is being formed.

In S1301, the CPU 606 charges a Q measurement capacitor C1 (see FIG. 11) in the Q measuring circuit 1102 prior to the charge amount measurement unit 108 causing the toner attracting surface 121 to attract the toner. In the present embodiment, a potential for causing the toner attracting surface 121 to electrostatically attract the toner (called a "toner attracting potential") is not supplied directly from the electrode power source 1104; instead, the Q measurement capacitor C1 (see FIG. 11) of the Q measuring circuit 1102 is first charged, and then power is supplied to the toner attracting surface 121 from the Q measurement capacitor C1. The reason power is not supplied directly from the electrode power source 1104 prior to toner attraction is to prevent the charge of the toner attracted to the toner attracting surface 121 from being discharged from the electrode power source 1104. Details of this process will be given later using FIG. 20.

Figure 21:
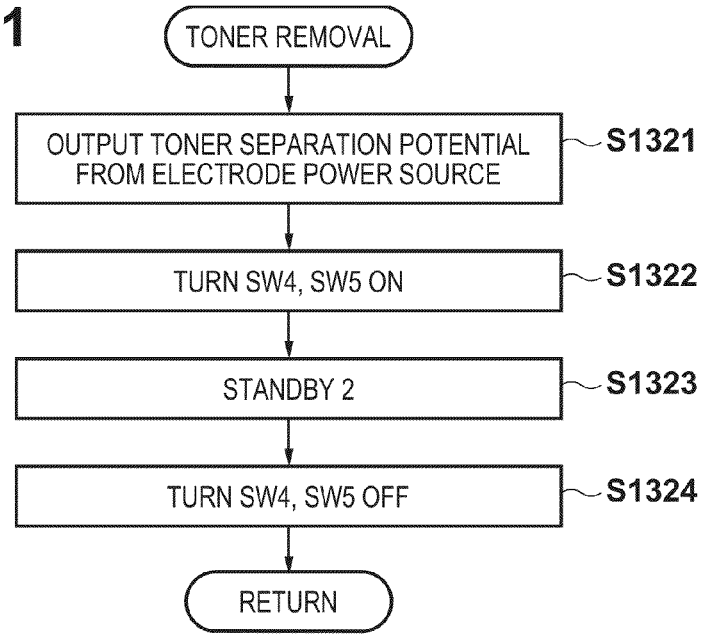
FIG. 21 is a flowchart illustrating a toner removal sequence.

In S1302, the CPU 606 separates the toner adhering to the toner attracting surface 121. The Q/M measuring unit 1101 applies a potential for separating the toner adhering to the toner attracting surface 121 (called a "toner separating potential") to the toner attracting surface 121 via the electrode 123, and causes the toner adhering to the toner attracting surface 121 to electrostatically separate. Details of this process will be given later using FIG. 21.

In S1303, the CPU 606 calculates a reference value V1 for a potential difference between both ends of the Q measurement capacitor C1 charged in step S1301 and a reference value f1 for the resonance frequency of the quartz chip 127, prior to causing the toner attracting surface 121 to attract the toner. Details of this process will be given later using FIG. 22.

In S1304, the CPU 606 causes the toner attracting surface 121 to electrostatically attract the toner using the toner attracting potential with which the Q measuring circuit 1102 has been charged. Details of this process will be given later using FIG. 23.

In S1305, the image forming apparatus 10 measures a potential difference V2 between both ends of the Q measurement capacitor C1 and a resonance frequency f2 of the quartz chip 127 in a state where the toner is attracted to the toner attracting surface 121.

In S1306, the CPU 606 detects the charge amount Q/M of the toner adhering to the toner attracting surface 121. The CPU 606 calculates the amount of electric charge Q of the toner attracted to the toner attracting surface 121 based on the reference value V1 of the potential difference measured before the toner is attracted to the toner attracting surface 121 and the potential difference V2 measured in a state where the toner is attracted to the toner attracting surface 121. Furthermore, the CPU 606 calculates the mass M of the toner attracted to the toner attracting surface 121 from the reference value f1 of the resonance frequency measured before the toner is attracted to the toner attracting surface 121 and the resonance frequency f2 measured in a state where the toner is attracted to the toner attracting surface 121, using Formula (1). The CPU 606 can then detect the charge amount Q/M of the toner by the Q/M calculation unit 1106 dividing the amount of electric charge Q of the toner attracted to the toner attracting surface 121 by the mass M.

In S1307, the CPU 606 determines whether to end the measurement or carry out the next calculation. In the present embodiment, the charge amount Q/M of the toner is measured while the image forming process is being carried out. In other words, in S1307, the CPU 606 returns the processing to S1301 in the case where the image forming process is being executed, and ends the toner charge amount measurement process in the case where the image forming process has ended.

Note that the amount of toner attracted to the toner attracting surface 121 from the photosensitive drum 101 in a single measurement is an extremely small amount, from several μg to several tens of μg, and thus does not affect the image formation.

In the present embodiment, the LUT correction unit 602 shown in FIG. 5 corrects the γLUT generated by the LUT creation unit using the measured toner charge amount. Note that the γLUT is data for converting an image signal that has been transferred into a laser driving signal. The laser driver 603 sets the pulse timing of the laser light in accordance with the content of the γLUT corrected by the LUT correction unit 602. When the laser scanner 103 exposes the photosensitive drum 101 with the laser light 100 whose pulse timing has been adjusted, an electrostatic latent image suited to the toner charge amount Q/M measured by the charge amount measurement unit 108 is formed upon the photosensitive drum 101.

Next, the respective processes in the toner charge amount measurement sequence shown in FIG. 7 will be described in detail. Note that FIG. 18 is a circuit diagram illustrating the Q/M measuring unit 1101, and FIG. 19 is a timing chart illustrating timings at which the switching circuit 1105 is switched on and off.

Circuit Configuration

Figure 18:
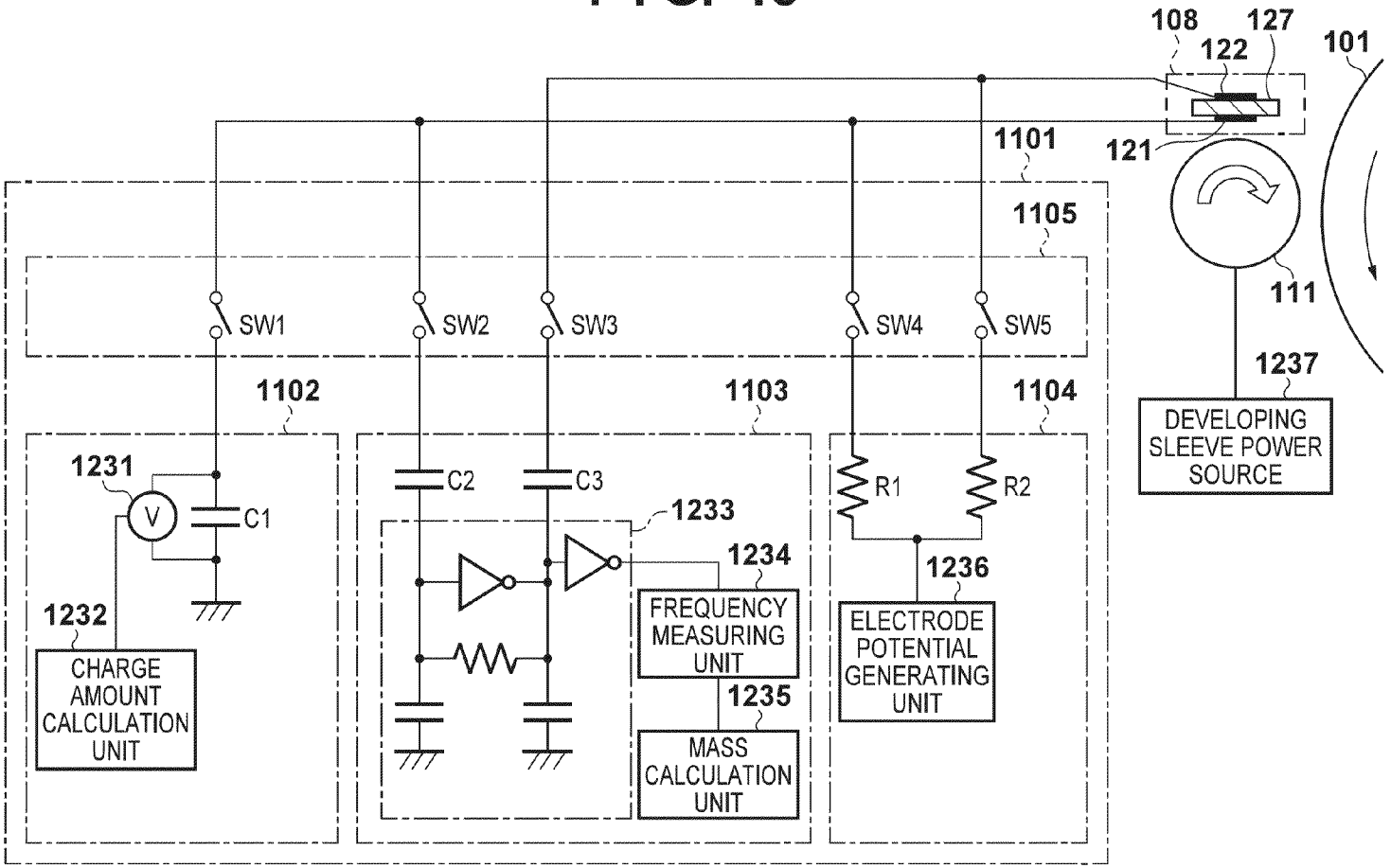
FIG. 18 is a circuit diagram illustrating a Q/M measuring unit.
Figure 19:
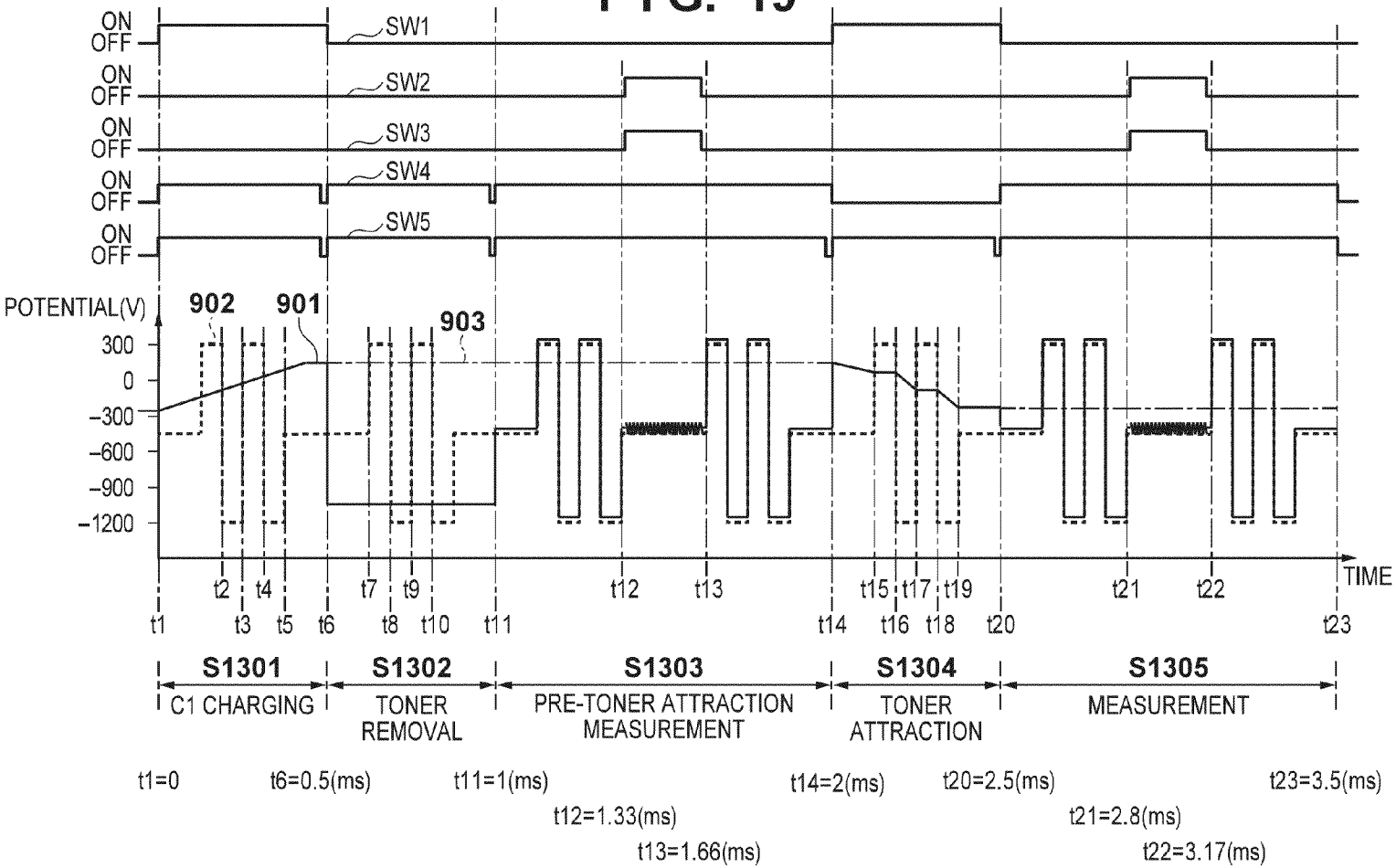
FIG. 19 is a timing chart illustrating switch operations.

Referring to FIG. 18, a switch SW1 electrically connects or disconnects the Q measuring circuit 1102 to or from the electrode 123. A switch SW2 electrically connects or disconnects the M measuring circuit 1103 to or from the electrode 123. A switch SW3 electrically connects or disconnects the M measuring circuit 1103 to or from the electrode 124 of the toner non-attracting surface 122. A switch SW4 electrically connects or disconnects the electrode power source 1104 to or from the electrode 123 of the toner attracting surface 121. A switch SW5 electrically connects or disconnects the electrode power source 1104 to or from the electrode 124 of the toner non-attracting surface 122.

The Q measurement capacitor C1 is a capacitor for measuring the amount of electric charge Q of the toner, and is charged to the toner attracting potential. A coupling capacitor C2 is inserted between the electrode 123 of the toner attracting surface 121 and the M measuring circuit 1103, and transmits only a high-frequency oscillation signal. A coupling capacitor C3 is inserted between the electrode 124 of the toner non-attracting surface 122 and the M measuring circuit 1103, and transmits only a high-frequency oscillation signal. Resistances R1 and R2 prevent the two electrodes 123 and 124 from shorting when an electrode potential generating unit 1236 is connected to both the electrode 123 of the toner attracting surface 121 and the electrode 124 of the toner non-attracting surface 122.

An electrometer 1231 measures the potential of the Q measurement capacitor C1. A charge amount calculation unit 1232 calculates the amount of electric charge Q based on a difference (V1−V2) between the reference value V1 of the potential difference between both ends of the Q measurement capacitor C1 measured before the toner is attracted to the toner attracting surface 121 and the potential difference V2 between both ends of the Q measurement capacitor C1 measured after the toner has been attracted to the toner attracting surface 121. In other words, the charge amount calculation unit 1232 corresponds to a charge amount detecting unit that detects a charge amount of the toner attracted to the toner attracting surface 121 based on a change in the potential difference between both ends of the Q measurement capacitor C1 when toner is attracted to the toner attracting surface 121. An oscillation circuit 1233 oscillates the quartz chip 127. Note that the oscillation circuit 1233 in FIG. 18 is an example of an oscillation circuit configured of a logic IC, a resistance, and a capacitor. However, the configuration of the oscillation circuit 1233 is not necessarily limited to this configuration, and another oscillation circuit may be used instead. A frequency measuring unit 1234 measures an oscillation frequency of the oscillation circuit 1233. A mass calculation unit 1235 calculates the mass M from a difference (f1−f2) between an oscillation frequency f1 measured before the toner is attracted to the toner attracting surface 121 and an oscillation frequency f2 measured after the toner has been attracted to the toner attracting surface 121. In other words, the mass calculation unit 1235 corresponds to a mass detecting unit that detects the mass of the toner attracted to the toner attracting surface 121.

The electrode potential generating unit 1236 outputs the toner attracting potential, the developing bias, the toner separating potential, a 0V potential, and so on. A developing sleeve power source 1237 applies the developing bias to the developing sleeve 111. In the present embodiment, the developing bias that alternates between a pulse period in which a voltage value changes cyclically between +300 V and −1200 V, for example, and a blank period in which the voltage value is constant is applied to the developing sleeve 111 (the developing bias will be referred to as a "blank pulse" hereinafter). Note that a DC component of the developing bias is −450 V. Note that the developing bias is not limited to this configuration, and may be a DC voltage, a sine wave, or the like; the developing bias may be set as appropriate based on the configuration of the developing apparatus 104, the composition of the toner, and so on.

Timing Chart

The timing chart in FIG. 19 illustrates a relationship between the on and off states of the switches SW1, SW2, SW3, SW4, and SW5, the potential of the developing sleeve 111 to which the blank pulse is applied, the surface potential of the toner attracting surface 121, and the potential difference between both ends of the Q measurement capacitor C1. A solid line 901 indicates the surface potential of the toner attracting surface 121. A dotted line 902 indicates the potential of the blank pulse applied to the developing sleeve 111. A dot-dash line 903 indicates the potential difference between both ends of the Q measurement capacitor C1. Note that because the Q measurement capacitor C1 is grounded, the potential difference between both ends of the Q measurement capacitor C1 is the potential of the Q measurement capacitor C1 itself.

The following descriptions assume that the blank period is one pulse, for the sake of simplicity. Meanwhile, it is also assumed that there are one or two pulses in each sequence, for the sake of simplicity.

Charging of Toner Attracting Potential

Figure 20:
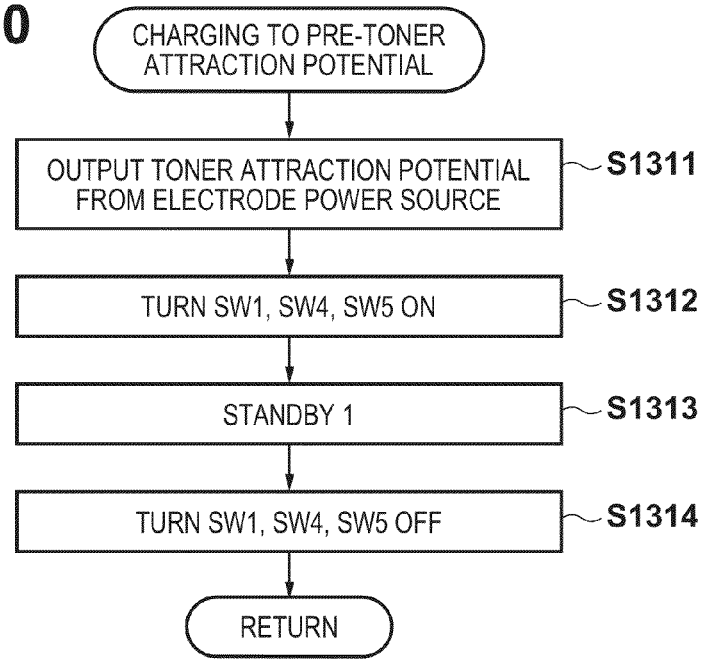
FIG. 20 is a flowchart illustrating a toner attracting potential charging sequence.

Using FIG. 20, a toner attracting potential charging sequence (S1301) in the toner charge amount measurement sequence (FIG. 7) will be described.

In S1311, the CPU 606 outputs the toner attracting potential from the electrode power source 1104. Here, a toner attracting potential of +150 V is output from the electrode power source 1104 in order to charge the Q measurement capacitor C1 to the toner attracting potential.

In S1312, the CPU 606 sets the switches SW1, SW4, and SW5 to on. The electrode power source 1104 and the Q measurement capacitor C1 are connected by setting the switches SW1 and SW4 to on. As a result, the Q measurement capacitor C1 begins to be charged to the toner attracting potential. A case where a −200 V potential, for example, remains in the Q measurement capacitor C1 will be described hereinafter.

Because the toner attracting surface 121 is connected to the Q measurement capacitor C1 via the switch SW1, there is almost no electrical resistance. On the other hand, the toner attracting surface 121 and the electrode power source 1104 are connected via the switch SW4 and the resistance R1. Accordingly, in the case where the switches SW1 and SW4 are turned on at time t1, the surface potential of the toner attracting surface 121 will be equal to the −200 V potential of the Q measurement capacitor C1 where there is no electrical resistance. Furthermore, the switch SW5 is turned on as well, and thus the toner non-attracting surface 122 and the toner attracting surface 121 have the same potential.

In S1313, the CPU 606 stands by until the potential difference at both ends of the Q measurement capacitor C1 reaches +150 V (standby 1). In the case where the toner attracting potential +150 V is output from the electrode power source 1104, the Q measurement capacitor C1 is charged until it reaches the toner attracting potential +150 V, as indicated by t1 to t6 in FIG. 19. The charging time is determined by the potential remaining in the Q measurement capacitor C1 and a time constant of the Q measurement capacitor C1 and the resistance R1.

In S1313, the toner attracting potential +150 V is also applied to the toner attracting surface 121. In times t2 to t3 and t4 to t5, the potential +150 V of the toner attracting surface 121 is +1350 V higher than the potential −1200 V of the developing sleeve 111, and thus the toner on the developing sleeve 111 is attracted to the toner attracting surface 121. However, the toner on the surface of the toner attracting surface 121 is removed in the next step, and thus there is no problem even if the toner is attracted to the toner attracting surface 121 in S1313. Furthermore, the charge of the toner attracted to the toner attracting surface 121 during the charging period is discharged through the electrode power source 1104 connected to the toner attracting surface 121.

Note that the configuration may be such that in S1313 the CPU 606 stands by for a predetermined amount of time, or a sensor for measuring the potential difference between both ends of the Q measurement capacitor C1 may be provided and the CPU 606 may stand by until a result of the measurement performed by the sensor indicates the target value of +150 V.

When the Q measurement capacitor C1 has been charged to the toner attracting potential, the process advances to S1314, where the CPU 606 switches the switch SW1 from on to off and cuts the electrical connection of the Q measurement capacitor C1. As a result, the Q measurement capacitor C1 is held at the toner attracting potential +150 V.

Through this, the process for charging to the toner attracting potential (S1301) is completed.

Pre-measurement Toner Removal

After the charging has been completed through the process of S1301, the toner attracted to the toner attracting surface 121 is removed. Using FIG. 21, a toner removal sequence (S1302) in the toner charge amount measurement sequence (FIG. 7) will be described.

In S1321, the CPU 606 outputs the toner separating potential from the electrode power source 1104. In the present embodiment, the CPU 606 applies a −1050 V toner separating potential to the toner attracting surface 121 using the electrode power source 1104 in order to separate the toner adhering to the toner attracting surface 121.

In S1322, the CPU 606 sets the switches SW4 and SW5 to on. When the switch SW4 and the switch SW5 are set to on, the electrode power source 1104, the toner attracting surface 121, and the two electrodes 123 and 124 of the toner non-attracting surface 122 are connected and the toner separating potential −1050 V is supplied thereto. The −1050 V toner separating potential is applied to the toner attracting surface 121 and the toner non-attracting surface 122, and the toner begins to be separated from the toner attracting surface 121. Note that the switch SW5 is set to on and the toner separating potential is supplied to the toner non-attracting surface 122 as well in order to prevent the QCM sensor 120 of the charge amount measurement unit 108 from being damaged.

In S1323, the CPU 606 stands by for a set period (standby 2). In times t7 to t8 and t9 to t10 in FIG. 19, the potential of the toner attracting surface 121 indicated by the solid line 901 (−1050 V) is 1350 V lower than the potential of the developing sleeve 111 indicated by the dotted line 902 (+300 V). Accordingly, the toner on the toner attracting surface 121 moves toward the developing sleeve 111, thus separating from the toner attracting surface 121. The CPU 606 stands by until the toner on the toner attracting surface 121 has sufficiently separated. Note that in S1323, the CPU 606 stands by for a predetermined amount of time, for example.

After the toner has separated from the toner attracting surface 121, in S1324, the CPU 606 completes the removal of the toner from the toner attracting surface 121 by setting the switch SW4 and the switch SW5 to off. Note that because the switch SW1 between the Q measuring circuit 1102 and the toner attracting surface 121 is continually off in this sequence, the potential of the Q measurement capacitor C1 is held at the +150 V toner attracting potential.

Pre-Toner Attraction Measurement Sequence

Figure 22:
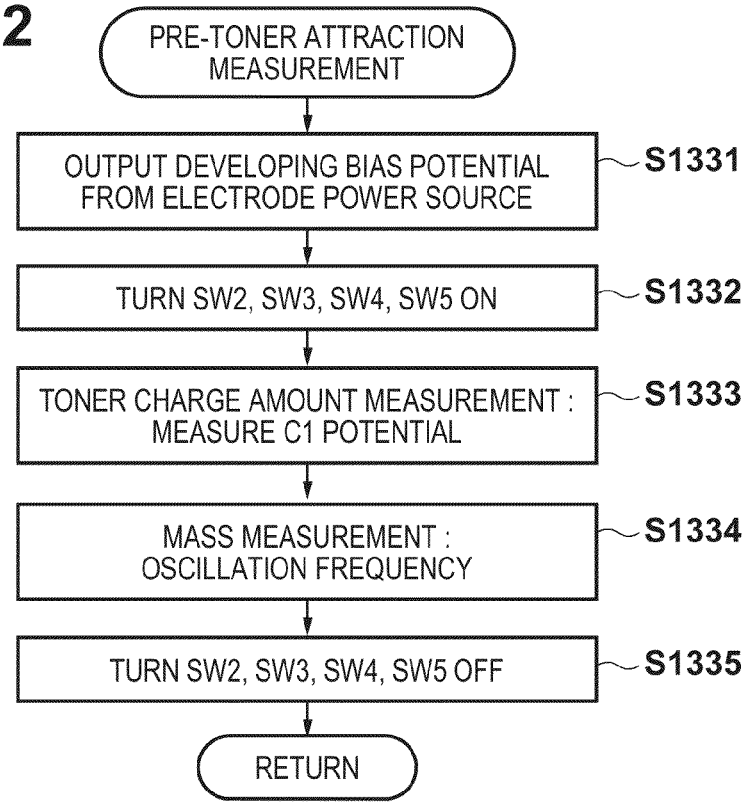
FIG. 22 is a flowchart illustrating a pre-toner attracting measurement sequence.

Using FIG. 22, a pre-toner attraction measurement sequence (S1303) in the toner charge amount measurement sequence (FIG. 7) will be described. The CPU 606 executes the measurement sequence of S1303 before the toner is attracted to the toner attracting surface 121, and measures the reference value V1 of the potential difference between both ends of the Q measurement capacitor C1 along with the resonance frequency f1 of the quartz chip 127.

In S1331, the CPU 606 outputs the developing bias from the electrode power source 1104. In order to ensure that toner is not attracted to the toner attracting surface 121 while the reference value is being measured, the CPU 606 applies the developing bias to the toner attracting surface 121 and controls the developing sleeve 111 and the toner attracting surface 121 to take on the same potential. In other words, the CPU 606 supplies the blank pulse from the electrode power source 1104 to the developing sleeve 111. Note that a slight potential difference may be present between the blank pulse supplied from the electrode power source 1104 to the toner attracting surface 121 and the blank pulse supplied from the developing sleeve power source 1237 to the developing sleeve 111 as long as no toner is attracted from the developing sleeve 111 to the toner attracting surface 121. Here, the blank pulse applied to the toner attracting surface 121 in FIG. 19 is 20 V higher than the blank pulse applied to the developing sleeve 111. For example, the voltage value changes cyclically between +320 V and −1180 V in the pulse period, and the voltage value is −430 V in the blank period.

In S1332, the CPU 606 sets the switches SW2, SW3, SW4, and SW5 to on. The element in the oscillation circuit 1233 will be damaged if the blank pulse is applied directly to the oscillation circuit 1233 from the electrode power source 1104, and thus the coupling capacitors C2 and C3 are provided in the oscillation circuit 1233.

The coupling capacitors C2 and C3 allow high-frequency signals to pass through but do not allow DC signals and low-frequency signals to pass through. Assuming that the oscillation frequency of the oscillation circuit 1233 is 5 MHz, the cycle thereof is 0.2 μs. The change time of the developing bias is set to a value that is longer than the cycle, such as 2 μs, so that the 5 MHz oscillation signal passes through the coupling capacitors C2 and C3 and fluctuations in the developing bias whose change time is 2 μs are blocked. Through this, a high-potential developing bias is prevented from being applied to the oscillation circuit 1233, which operates at several V.

In S1333, the CPU 606 measures the potential difference V1 between both ends of the Q measurement capacitor C1 before the toner is attracted to the toner attracting surface 121. Here, the CPU 606 measures the potential difference between both ends of the Q measurement capacitor C1 using the electrometer 1231 during the blank period (for example, during a period from time t12 to t13). The potential difference V1 is measured in this blank period in order to avoid the effects of electromagnetic waves emitted during the pulse period. The measured potential difference V1 is recorded in the charge amount calculation unit 1232 as a pre-toner attraction potential V1. Note that because the switch SW1 is off, the Q measuring circuit 1102 is isolated from the other circuits. The process for measuring the pre-toner attraction reference value V1 may be executed in parallel with the next step in order to reduce the measurement time.

In S1334, the CPU 606 measures the resonance frequency f1 of the quartz chip 127 before the toner is attracted to the toner attracting surface 121. Here, the CPU 606 measures the oscillation frequency of the oscillation circuit 1233 using the frequency measuring unit 1234 during the blank period (for example, the period from time t12 to t13). The resonance frequency f1 is measured during the blank period in order to avoid the effects of fine potential fluctuations of less than or equal to several V that cannot completely be removed in the coupling capacitors C2 and C3. The measured frequency f1 is recorded in the mass calculation unit 1235 as a pre-toner attraction frequency f1.

Then, in S1335, the CPU 606 sets the switches SW2, SW3, SW4, and SW5 to off, and ends the measurement of the pre-toner attraction potential V1 and the pre-toner attraction frequency f1. Note that the configuration may be such that the pre-toner attraction potential V1 and the pre-toner attraction frequency f1 are each measured a plurality of times. In the case of such a configuration, an average of the potential differences between both ends of the Q measurement capacitor C1 measured repeatedly during the blank period before toner attraction is used as the pre-toner attraction potential V1 and an average of the resonance frequencies measured repeatedly during the blank period before toner attraction is used as the pre-toner attraction frequency f1. Although this increases the amount of time required to calculate the pre-toner attraction potential V1 and the pre-toner attraction frequency f1, doing so makes it possible to improve the detection accuracy.

Toner Attraction

Figure 23:
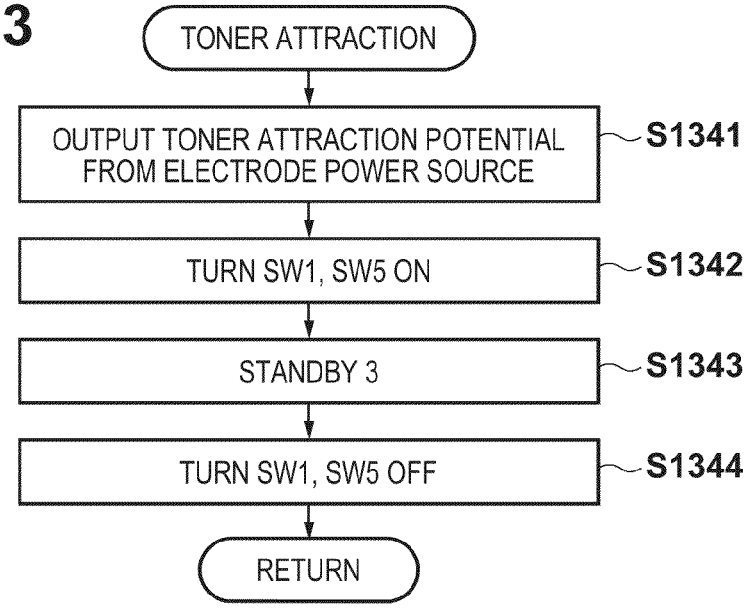
FIG. 23 is a flowchart illustrating a toner attracting sequence.

Next, using FIG. 23, a toner attracting sequence (S1304) in the toner charge amount measurement sequence (FIG. 7) will be described.

In S1341, the CPU 606 outputs the toner attracting potential from the electrode power source 1104 in order to prevent the QCM sensor 120 from being damaged.

The toner attracting potential +150 V is output from the electrode power source 1104 to the toner non-attracting surface 122 in order to set the toner non-attracting surface 122 and the toner attracting surface 121 to the same potential.

In S1342, the CPU 606 sets the switches SW1 and SW5 to on. The toner attracting surface 121 and the Q measurement capacitor C1 are connected as a result of the switch SW1 being set to on, and the toner attracting potential +150 V with which the Q measurement capacitor C1 is charged is applied to the toner attracting surface 121. As a result, the toner on the developing sleeve 111 is attracted to the toner attracting surface 121. At this time, the toner attracting potential +150 V is also applied to the toner non-attracting surface 122 as a result the switch SW5 being set to on, preventing the charge amount measurement unit 108 from being damaged.

In S1343, the CPU 606 stands by for a set period (standby 3). From time t14 to t15 (see FIG. 19), the potential of the developing sleeve 111 (−450 V) is 600 V lower than the potential of the toner attracting surface 121 (+150 V), and thus some of the highly-charged toner on the developing sleeve 111 is attracted to the toner attracting surface 121. Furthermore, as indicated by the solid line 901 (see FIG. 19), the potential of the toner attracting surface 121 changes in the negative direction due to the negative charge of the attracted toner. At time t15 (see FIG. 19), the potential of the toner attracting surface 121 becomes +100 V.

From time t15 to t16 (see FIG. 19), the potential of the developing sleeve 111 (+300 V) is 200 V higher than the potential of the toner attracting surface 121 (+100 V), and thus the toner does not move from the developing sleeve 111 to the toner attracting surface 121. At this time, the potential of the toner attracting surface 121 remains at +100 V.

From time t16 to t17 (see FIG. 19), the potential of the developing sleeve 111 (−1200 V) is 1300 V lower than the potential of the toner attracting surface 121 (+100 V), and thus the toner on the developing sleeve 111 is attracted to the toner attracting surface 121. As indicated by the solid line 901 (see FIG. 19), when the toner is attracted to the toner attracting surface 121, the potential thereof becomes −50 V. From time t17 to t18 (see FIG. 19), the potential of the developing sleeve 111 (+300 V) is 350 V higher than the potential of the toner attracting surface 121 (−50 V), and thus the toner does not move from the developing sleeve 111 to the toner attracting surface 121.

From time t18 to t19 (see FIG. 19), the potential of the developing sleeve 111 (−1200 V) is 1150 V lower than the potential of the toner attracting surface 121 (−50 V), and thus the toner on the developing sleeve 111 is attracted to the toner attracting surface 121. As indicated by the solid line 901 (see FIG. 19), when the toner is attracted to the toner attracting surface 121, the potential thereof becomes −200 V.

From time t19 to t20 (see FIG. 19), the potential of the developing sleeve 111 (−450 V) is 250 V lower than the potential of the toner attracting surface 121 (−200 V), and thus the toner on the developing sleeve 111 is attracted to the toner attracting surface 121. At this time, there is only a small potential difference between the potential of the developing sleeve 111 (−450 V) and the potential of the toner attracting surface 121 (−200 V), and thus an extremely small amount of toner is attracted to the toner attracting surface 121.

The CPU 606 stands by for a set period after the toner attracting potential has been supplied to the toner attracting surface 121 (standby 3). Note that in S1343, the CPU 606 stands by for a predetermined amount of time, for example. The potential of the Q measurement capacitor C1 drops in accordance with the charge of the toner attracted to the toner attracting surface 121. The amount of this potential change corresponds to the amount of electric charge Q of the toner.

In S1344, the CPU 606 stops the attraction of toner to the toner attracting surface 121 by setting the switch SW1 and the switch SW5 to off. At this time, the Q measurement capacitor C1 is disconnected from the toner attracting surface 121, and thus the Q measurement capacitor C1 holds the potential that has changed due to the toner attraction.

Measurement of Q and M

When the toner is attracted to the toner attracting surface 121, the CPU 606 executes the charge amount measurement sequence (S1305) indicated in the toner charge amount measurement sequence (FIG. 7), in a state where the toner is attracted. In other words, the CPU 606 measures the potential V2 of the Q measurement capacitor C1 while toner is attracted and measures the resonance frequency f2 of the quartz chip 127 while toner is attracted. Here, because the developing bias has the pulse period and the blank period, the potential V2 of the Q measurement capacitor C1 and the resonance frequency f2 are measured during a period from time t21 to t22 (see FIG. 19). Note that the measurement sequence for the potential difference V2 and the resonance frequency f2 while toner is attracted employs the same method as the pre-toner attraction measurement sequence illustrated in FIG. 22, and thus descriptions thereof will be omitted.

Calculation of Amount of Electric Charge Q

The charge amount calculation unit 1232 calculates the amount of electric charge Q of the toner attracted to the toner attracting surface 121. The amount of electric charge Q can be calculated through the following Formula (2) based on the pre-toner attraction potential V1, the potential V2 while toner is attracted, and a capacitance value C of the Q measurement capacitor C1.

$$Q=Cx(V1-V2) \tag{2}$$

Calculation of Mass M

The mass calculation unit 1235 calculates the mass M of the toner attracted to the toner attracting surface 121. The mass M can be calculated through Formula (3) based on the pre-toner attraction frequency f1 and the resonance frequency f2 while the toner is attracted. Note that Formula (3) is a modification of Formula (1).

$$M = -(f_2 - f_1) \times \frac{A\sqrt{\mu - p}}{2 \times (f_0)^2} \tag{3}$$

Calculation of Charge Amount Q/M

The toner charge amount Q/M is calculated based on the amount of electric charge Q measured by the Q measuring circuit 1102 and the mass M measured by the M measuring circuit 1103. The toner charge amount Q/M is calculated immediately after the amount of electric charge Q and the mass M have been calculated following t22 indicated in the timing chart in FIG. 19.

The toner charge amount Q/M is calculated through Formula (4).

$$Q/M=(\text{amount of electric charge } Q)/(\text{mass } M) \tag{4}$$

Meanwhile, when the electrode surface area of the toner attracting surface 121 is represented by S, an amount of electric charge Q/S per unit of surface area and a mass M/S per unit of surface area can be found for the amount of electric charge Q and the mass M of the toner.

In this manner, the mass M and the amount of electric charge Q of the toner attracted to the toner attracting surface 121 are measured accurately, and the charge amount of the toner on the developing sleeve 111, or in other words, the charge amount of the toner used in the development, is detected accurately.

Tone Correction Control Process

An updating process for updating a γLUT for correcting an image signal will be described hereinafter.

Figure 8A:
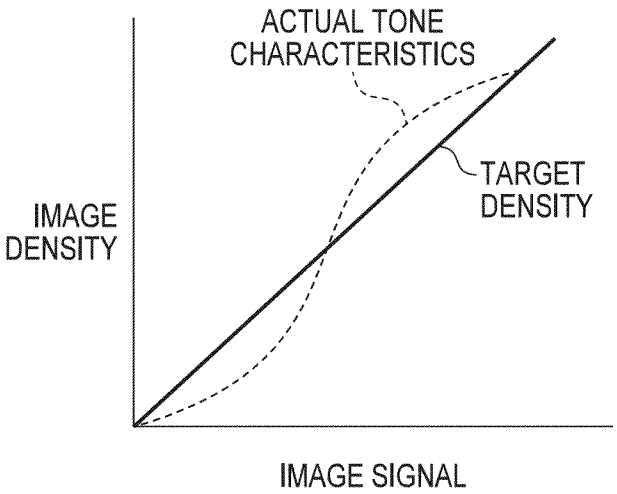
FIGS. 8A and 8B are graphs illustrating a relationship between an image signal and an image density.
Figure 8B:
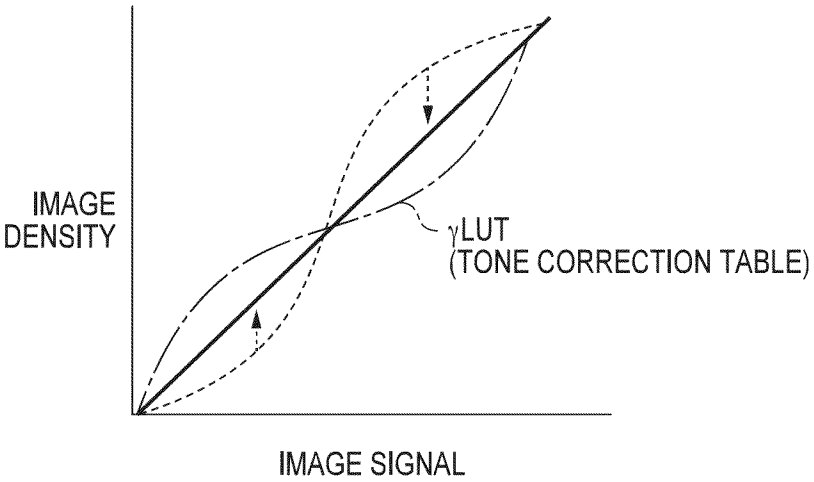

FIGS. 8A and 8B are graphs illustrating a relationship between an image signal and an image density. The image forming apparatus 10 has unique tone characteristics, and the density of an image formed in accordance with an input image signal will not correspond to a desired density (called a "target density" hereinafter). The following will describe a case in which the relationship between the image signal in the image density is a relationship indicated by "actual tone characteristics" in FIG. 8A, for example. For the tone characteristics of the image forming apparatus, it is suitable for the density, brightness, or the like of an image output in response to the input image signal to be linear. To obtain desired tone characteristics, the LUT creation unit 601 of the controller 1107 performs an inverse transform on the "actual tone characteristics" in FIG. 8A, and creates the "γLUT", which is a tone correction table expressing the stated relationship (for example, the dot-dash line in FIG. 8B).

The γLUT is created through the following process. Based on a given plurality of image signals set in advance, the image forming apparatus 10 forms a patch image of different tones upon the photosensitive drum 101. Then, an optical sensor 607 disposed in a position facing the photosensitive drum 101 detects the density of the aforementioned patch image that has different tones.

The CPU 606 linearly interpolates a correspondence relationship between the image signal of the patch image and the result of detecting the density of the patch image. Through this, the CPU 606 obtains a correspondence relationship between the image signal and the image density, or in other words, obtains the tone characteristics. The CPU 606 creates the γLUT based on these tone characteristics. It is necessary for the γLUT to output a patch image having a plurality of tones, and it is thus difficult to create the γLUT in a short amount of time. Skew may arise in the γLUT during printing due to the effects of environmental fluctuations, material variations, and so on, and there are thus cases where the desired image density cannot be obtained. Accordingly, in the present embodiment, tone correction control is carried out for correcting the γLUT in a short amount of time, during printing or the like.

Upon image data being input into the controller 1107, the CPU 606 corrects an image signal contained in the image data using the γLUT. Once halftone processing and PWM processing have been carried out on the corrected image signal, the image signal is input into the laser driver 603 as the laser driving signal. As a result, the laser scanner 103 irradiates the photosensitive drum 101 with laser light based on the laser driving signal, and the electrostatic latent image is formed. Thereafter, the electrostatic latent image is developed with toner by the developing apparatus 104, the toner is transferred onto paper via the intermediate transfer belt 115 and fixed by a fixing apparatus 107, and then output.

The γLUT is stored in advance in a storage medium such as a non-volatile memory (for example, the ROM 605). The timing at which the γLUT is updated is, for example, immediately after the image forming apparatus 10 has been turned on, after a predetermined number of pages' worth of images have been printed, or in the case where it is possible that the tones will change dramatically.

Reference Toner Charge Amount Measurement

A reference toner charge amount measurement process is carried out at the same time as the γLUT creation sequence. The reference toner charge amount measurement process will be described hereinafter based on FIG. 9.

First, when the image forming apparatus 10 is turned on, the CPU 606 starts the rotational driving of the developing sleeve 111 and the agitating screw 118 in the developing apparatus 104 in order to increase the charge amount of the toner (S701). In the following descriptions, the process for rotationally driving the developing sleeve 111 and the agitating screw 118 before starting the image forming process will be referred to as a "pre-rotation process".

Next, the CPU 606 causes the aforementioned patch image to be formed (S702), and carries out the toner charge amount measurement sequence (FIG. 7) while the developing apparatus 104 is developing the patch image (S703).

The CPU 606 carries out the toner charge amount measurement sequence (FIG. 7) and calculates the amount of electric charge Q of the toner and the mass M of the toner, and measures a time to at which the toner charge amount measurement sequence was carried out (S704). The CPU 606 then detects the toner charge amount Q/M from the amount of electric charge Q of the toner and the mass M of the toner (S705), and holds that value in a memory (S706).

Next, the CPU 606 determines whether or not the developing apparatus 104 has finished developing a pre-set number of patch images (S707). The CPU 606 returns the process to S704 in the case where the developing apparatus 104 has not finished developing all of the pre-set number of patch images in S707.

However, the CPU 606 advances the process to S708 in the case where the developing apparatus 104 has finished developing all of the pre-set number of patch images. Then, the CPU 606 compares toner charge amounts $Q/M_n$ measured at the times tn while the patch images are being developed, sets the maximum value of the charge amount as a reference toner charge amount $Q/M_{ref}$ (S708), and holds that value in a memory (S709).

Note that the configuration may be such that in the case where the maximum value of the toner charge amounts $Q/M_n$ measured at each time tn has not reached the target value $(Q/M)_b$, the CPU 606 estimates the reference toner charge amount $Q/M_{ref}$ based on the movement of the toner charge amounts $Q/M_n$.

γLUT Correction Control

An image signal resulting in a desired image density is obtained by creating the reference γLUT and then correcting the image signal contained in the image data using the reference γLUT, as described above. However, as described earlier, even if the reference γLUT is used, skew arises between the density of the image formed in accordance with the corrected image signal and the desired image density.

Figure 10:
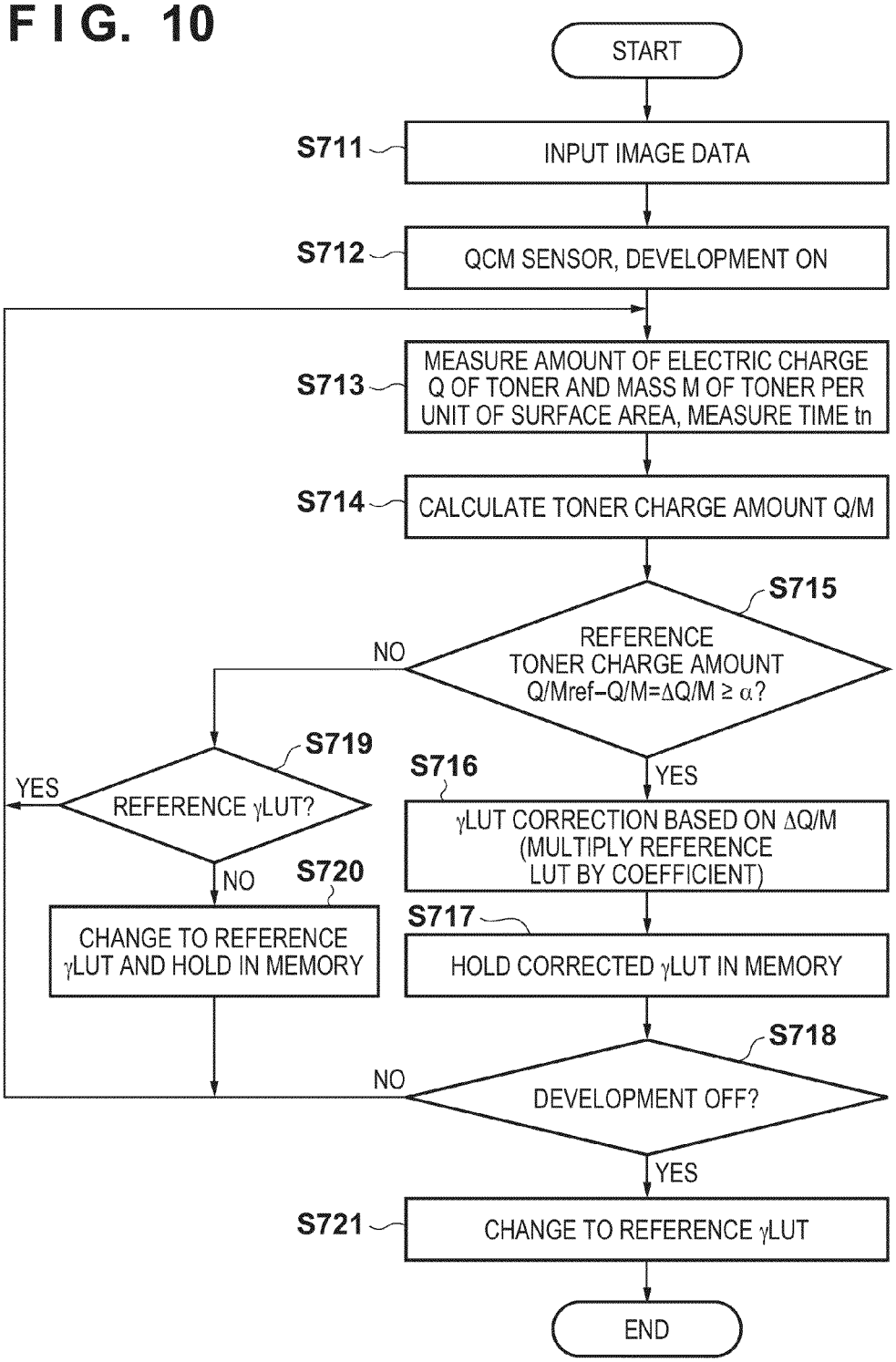
FIG. 10 is a flowchart illustrating a γLUT correction process according to the first embodiment.

Accordingly, in the present embodiment, control is carried out for correcting the γLUT in accordance with the toner charge amount Q/M obtained in the toner charge amount measurement sequence. FIG. 10 is a flowchart illustrating a γLUT correction process executed in parallel with image formation.

First, when the image data is input into the controller 1107 (S711), the CPU 606 starts the image forming process for forming an image in accordance with the image data (development ON), and starts the toner charge amount measurement sequence (QCM sensor ON) (S712). The image forming apparatus 10 carries out the toner charge amount measurement sequence (FIG. 7) and calculates the amount of electric charge Q of the toner and the mass M of the toner, measures the time to at which the toner charge amount measurement sequence was carried out, and stores the values in a memory (S713).

Next, the CPU 606 calculates the toner charge amount Q/M from the amount of electric charge Q of the toner and the mass M of the toner (S714).

Then, in S715, the CPU 606 calculates a difference between the toner charge amount Q/M and the reference toner charge amount $Q/M_{ref}$ held in advance in a memory (a deviation ΔQ/M) using Formula (5).

$$\Delta Q/M = |Q/M_{ref} - Q/M| \tag{5}$$

The CPU 606 then determines whether or not the deviation ΔQ/M of the toner charge amount is greater than or equal to a threshold α. The threshold α is determined in accordance with the reference toner charge amount $Q/M_{ref}$, which varies depending on the type of the developing material, the ratio of toner to carrier, and so on. In the present embodiment, when the reference toner charge amount $Q/M_{ref}$=−60 μC/g, for example, α=3 μC/g. In the case where the deviation ΔQ/M of the toner charge amount is less than the threshold α (S715: NO), the CPU 606 advances the process to S719.

In S719, the CPU 606 determines whether or not the γLUT is the reference γLUT stored in advance. In the case where the γLUT is the reference γLUT (S719: YES), the CPU 606 returns the process to S713. On the other hand, in the case where the γLUT is not the reference γLUT (S719: NO), the CPU 606 changes the γLUT to the reference γLUT (S720). The CPU 606 then returns the process to S713.

In the case where the deviation ΔQ/M of the toner charge amount is greater than or equal to the threshold α (S715: YES), the CPU 606 advances the process to S716. In S716, the CPU 606 corrects the γLUT based on the deviation ΔQ/M of the toner charge amount.

Figure 11:
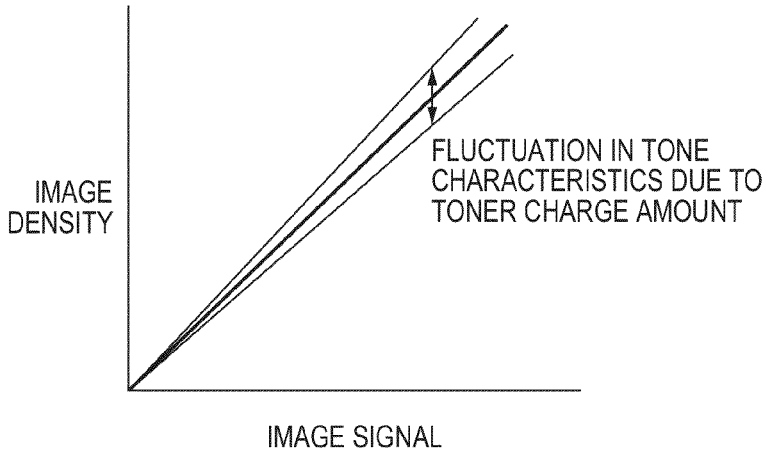
FIG. 11 is a diagram illustrating tone characteristics occurring when the charge amount of the toner is changed.

Fluctuations in the tone characteristics resulting from the toner charge amount changing will be described based on the schematic diagram shown in FIG. 11. The image density relative to the image signal behaves as shown in FIG. 11 as a result of changes in the toner charge amount. According, in the present embodiment, the configuration is such that the CPU 606 corrects the γLUT using the LUT correction unit 602 based on the deviation ΔQ/M of the toner charge amount. For example, the configuration is such that the γLUT is multiplied by a coefficient k. Here, the coefficient k is calculated through Formula (6).

$$k=(Q/MW(Q/M_{ref}) \quad (6)$$

Note that the toner charge amount $Q/M_n$ is the toner charge amount measured at the time tn.

After correcting the γLUT by multiplying the γLUT by the coefficient k in S716 of FIG. 10, the CPU 606 holds the corrected γLUT in a memory (S717).

In the present embodiment, a rotational velocity of the developing sleeve 111 is set so that a time Tqcm necessary for the developing sleeve 111 to rotate from a position closest to the charge amount measurement unit 108 (the measurement position) to a position closest to the photosensitive drum 101 (the developing position) fulfills Formula (7). Here, the time necessary for the electrostatic latent image on the photosensitive drum 101 to move from the position on the photosensitive drum 101 irradiated by the laser light 100 from the laser scanner 103 (the exposure position) to the developing position is represented by Tetd. Furthermore, the time necessary to control the exposing conditions based on the toner charge amount is represented by Tp.

$$Tqcm \geq Tetd+Tp \quad (7)$$

Figure 12:
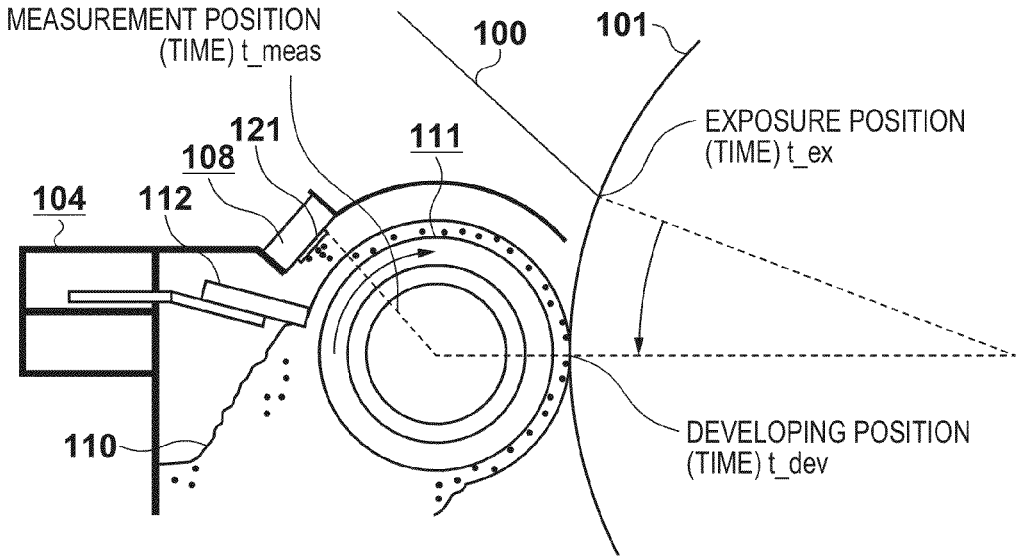
FIG. 12 is a diagram illustrating a measurement position, an exposure position, and a developing position according to the first embodiment.

FIG. 12 is a schematic diagram illustrating the exposure position (t_ex), the measurement position (t_meas), and the developing position (t_dev). If the measurement position of the charge amount measurement unit 108 is set so that Formula (7) holds true, the pulse timing of the laser light emitted at the exposure position is controlled in accordance with the toner charge amount detected at the measurement position. When the electrostatic latent image on the photosensitive drum 101 exposed by this laser light reaches the developing position, the toner whose charge amount has been detected at the measurement position is supplied to the electrostatic latent image, and thus an image having the desired density can be formed on the photosensitive member.

Referring again to FIG. 10, the CPU 606 determines whether or not the image forming process has ended (development OFF) (S718). In the case where the developing apparatus 104 is developing an image based on the image data in S718 (S718: NO), the process returns to the toner charge amount measurement sequence in S713.

On the other hand, in the case where the developing apparatus 104 has finished developing the image based on the image data in S718 (S718: YES), the CPU 606 changes the γLUT to the reference γLUT (S721) and ends the correction process. This correction process is repeatedly executed each time one page's worth of an image is formed.

According to the present embodiment, it is possible to set exposing conditions under which a toner image having a desired density can be formed, even in the case where the charge amount of the toner in the developing apparatus 104 changes while an image read by a scanner, an image transferred from an external PC, or the like is being printed. It is therefore possible to print a high-quality image in a stable manner even in the case where the charge amount of the toner in the developing apparatus 104 has fluctuated.

Second Embodiment

According to the first embodiment, real-time control is carried out using a configuration that corresponds to FIG. 12 and Formula (7), but because the measurement position and the exposure position are close to each other, it is possible that the control of the exposing conditions will be too late in the case where even a slight amount of delay, such as signal delay, occurs.

Figure 24:
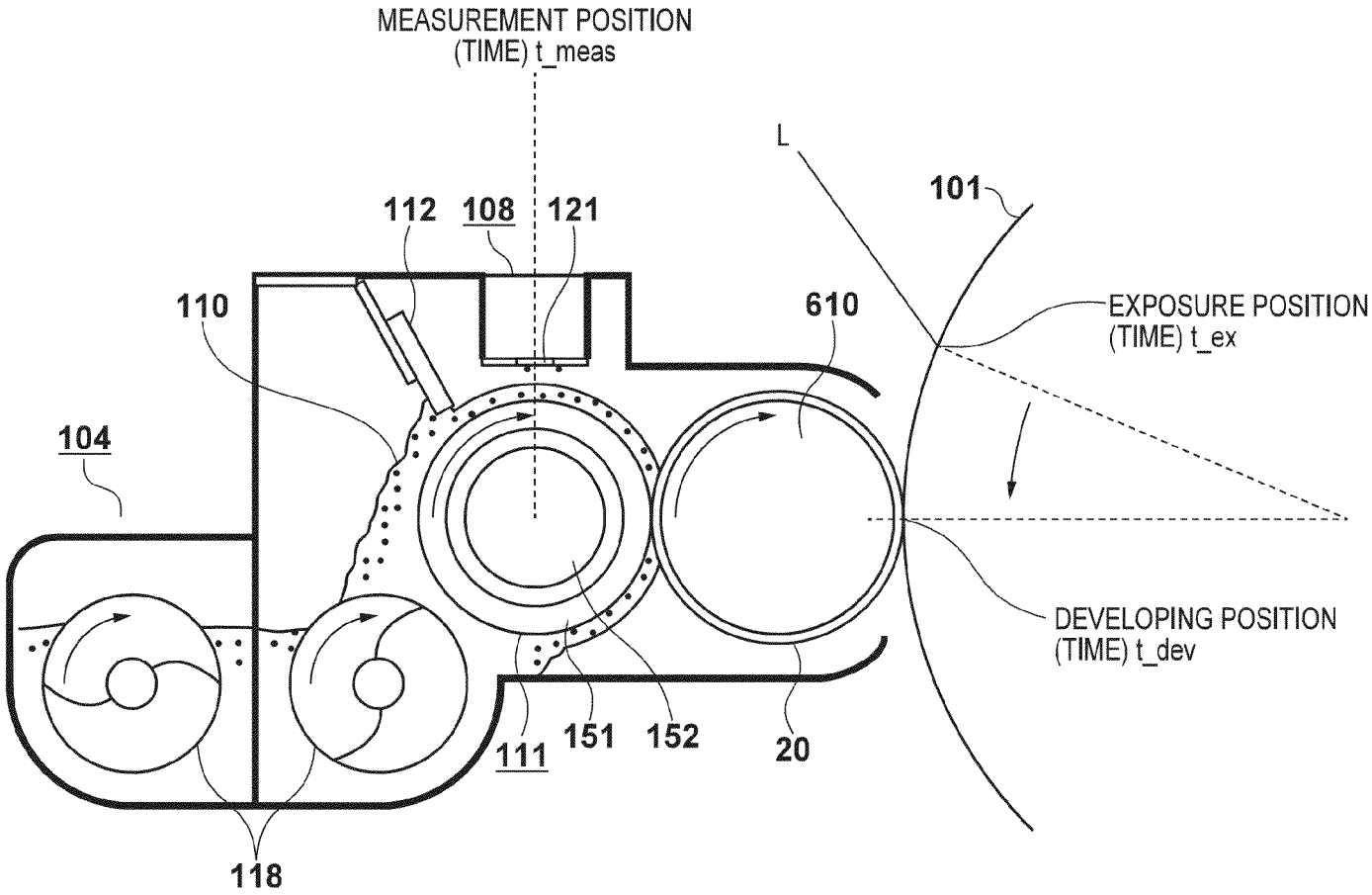
FIG. 24 is a schematic diagram illustrating the configuration of a developing apparatus according to a second embodiment.

Accordingly, in the second embodiment, the configuration of the developing apparatus 104 is changed in order to lengthen the time Tqcm from the measurement position to the developing position. FIG. 24 is a schematic diagram illustrating the configuration of the developing apparatus 104 according to the second embodiment. The operations of the image forming apparatus and the operations performed in the toner charge amount measurement sequence are the same as those described in the first embodiment, and thus descriptions thereof will be omitted in the present embodiment. The developing apparatus 104 shown in FIG. 24 is a hybrid developing apparatus. The differences between the developing apparatus shown in FIG. 12 and described in the first embodiment and the developing apparatus according to the present embodiment will be described hereinafter.

A developing roller 610 is added between the developing sleeve 111 and the photosensitive drum 101. The developing material 110 held on the developing sleeve 111 is developed on the developing roller 610, and only toner 20 is borne on the developing roller 610. The toner on the developing roller 610 is conveyed to the developing position as a result of the developing roller 610 rotating, and the electrostatic latent image on the photosensitive drum 101 is developed. With this configuration, the time until the developing position is reached can be made longer than in the first embodiment, even in the case where the charge amount measurement unit 108 is disposed in a position facing the toner on the developing sleeve 111 after passing the regulation blade 112.

According to the present embodiment, the time Tqcm from when the toner in the developing apparatus 104 moves from the measurement position to the developing position can be increased.

Third Embodiment

In the first embodiment, the charge amount measurement unit 108 is disposed in a position, facing the developing sleeve 111, in a path along which the toner on the developing sleeve 111 traverses the regulation blade 112 and reaches the developing position.

However, in the case where the conditions illustrated in FIG. 12 and indicated by Formula (7) are not met, real-time tone control cannot be carried out. For example, apparatuses that increase the rotational velocity of the developing sleeve 111 in order to increase the printing speed, apparatuses in which the diameter of the developing sleeve 111 has been reduced in order to miniaturize the apparatus, and so on may not be able to meet the condition indicated in Formula (7).

In the third embodiment, the exposing conditions are controlled in accordance with a predicted result of measuring the toner charge amount even in the case where the exposing conditions cannot be controlled in real time.

Figure 13A:
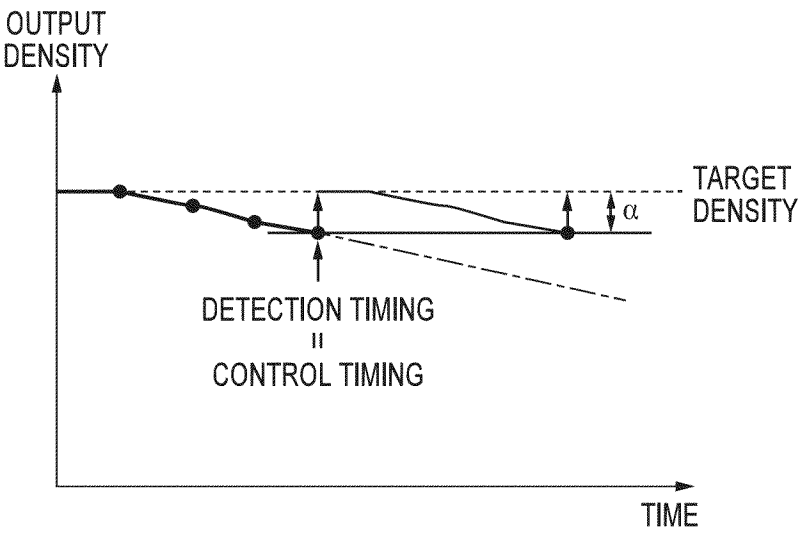
FIGS. 13A and 13B are diagrams illustrating transitions in the density of an output image according to a third embodiment.
Figure 13B:
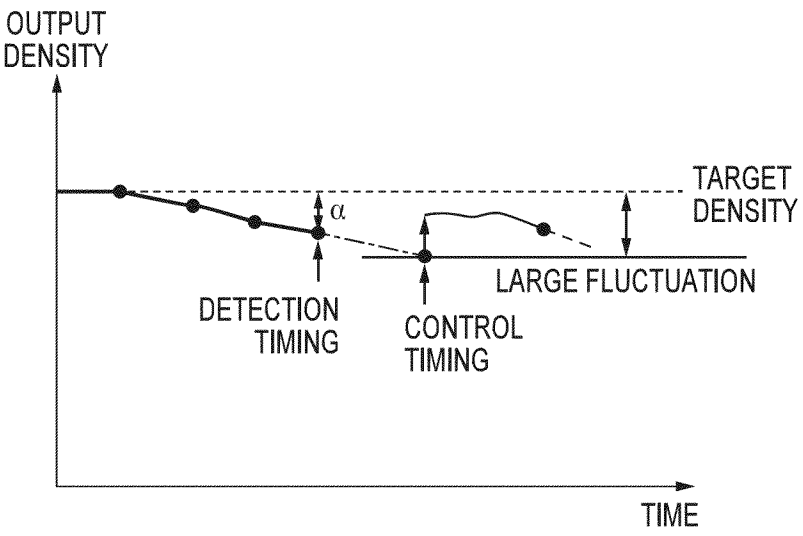

FIGS. 13A and 13B are diagrams illustrating fluctuations in the density of an output image. As illustrated in, for example, FIG. 13A, a configuration that fulfills Formula (7) controls the exposing conditions immediately based on a detection result obtained at a detection timing at which the toner charge amount is detected, and thus the deviation ΔQ/M of the toner charge amount can be kept under the threshold α.

However, as illustrated in, for example, FIG. 13B, with a configuration that does not fulfill Formula (7), an image is formed during a period from the detection timing to a control timing at which the exposing conditions are controlled based on the detection result. Accordingly, the deviation ΔQ/M of the toner charge amount cannot be kept below the threshold α. Accordingly, the present embodiment describes a configuration in which a timing at which the deviation ΔQ/M of the toner charge amount will become greater than or equal to the threshold α is predicted based on a result of repeatedly detecting the toner charge amount Q/M, and tone control is carried out at that timing.

Figure 14:
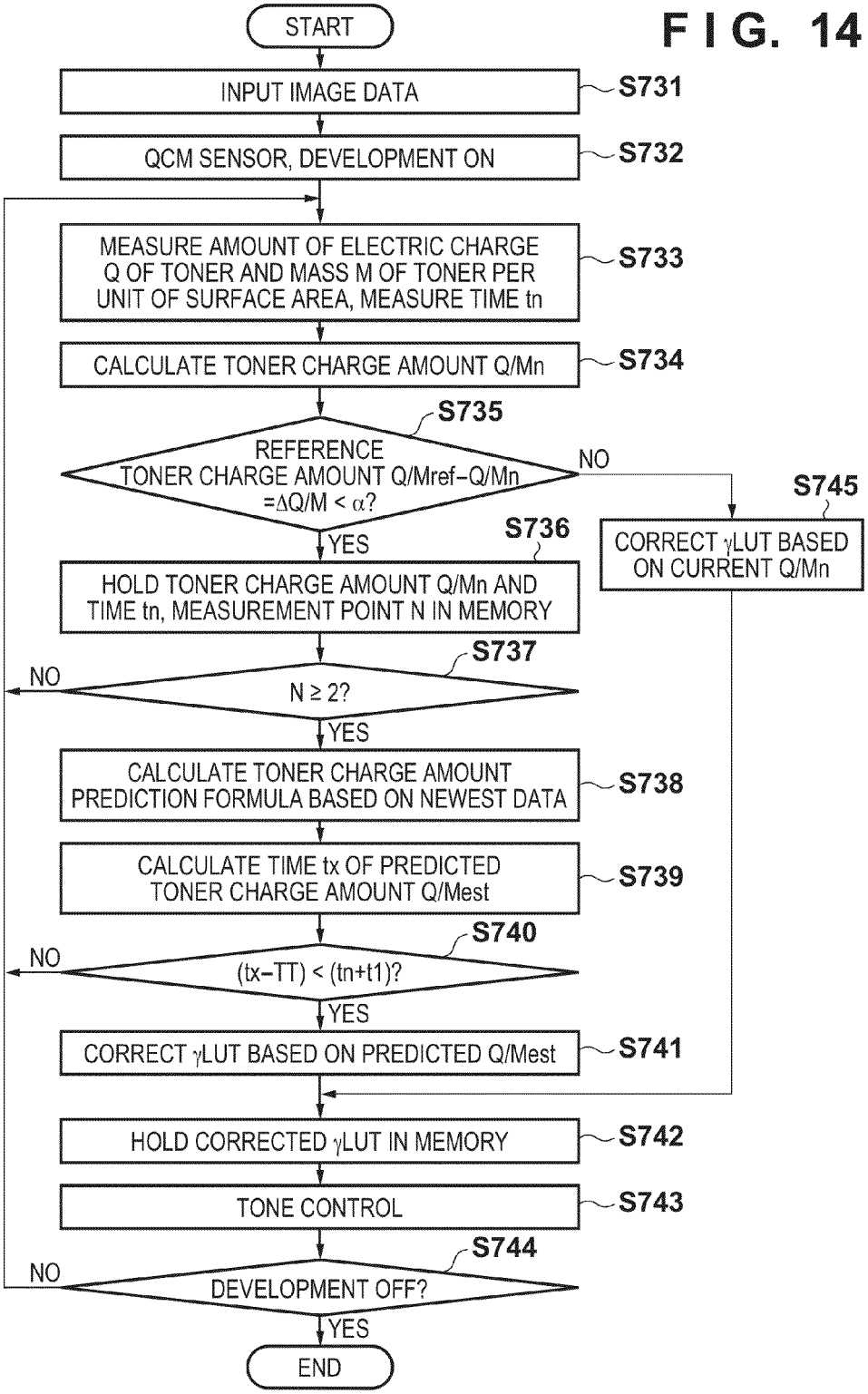
FIG. 14 is a flowchart illustrating a γLUT correction process according to the third embodiment.

FIG. 14 is a flowchart illustrating a γLUT correction process according to the present embodiment. Note that the configuration of the image forming apparatus is the same as that described in the first embodiment, and thus detailed descriptions thereof will be omitted here.

First, when the image data is input into the controller 1107 (S731), the CPU 606 starts the image forming process for forming an image in accordance with the image data (development ON), and starts the toner charge amount measurement sequence (S732).

Next, the CPU 606 measures the amount of electric charge Q of the toner and the mass M of the toner at the time to (S733), and calculates the toner charge amount $Q/M_n$ based on the results of those measurements (S734).

Then, the CPU 606 calculates the deviation ΔQ/M of the toner charge amount and determines whether or not the deviation ΔQ/M is less than the threshold α (S735). In the case where the deviation ΔQ/M is greater than or equal to the threshold α (S735: NO), the CPU 606 corrects the γLUT by multiplying the γLUT with the coefficient k calculated using Formula (6) (S745). The CPU 606 then advances the process to S742.

On the other hand, in the case where the deviation ΔQ/M of the toner charge amount is less than the threshold α (S735: YES), the CPU 606 stores the time to measured in S733, the toner charge amount $Q/M_n$ calculated in S734, and a measurement point N in a memory (S736). Here, the measurement point N represents the number of measurements carried out since the measurement was started, and N=1 when the measurement is the first measurement.

Next, the CPU 606 determines whether or not the measurement point N is greater than or equal to 2 (S737). In other words, the CPU 606 determines whether or not the toner charge amount has been detected two or more times. In the case where the measurement point N is less than 2 (S737: NO), the CPU 606 returns the process to S733, and the toner charge amount detection is continued. However, in the case where the measurement point N is greater than or equal to 2 (S737: YES), the CPU 606 advances the process to S738.

At this time, in the case where the measurement point N is greater than or equal to 2, the data of at least two toner charge amounts $Q/M_{n-1}$, $Q/M_n$, and so on is stored. Using the newest detection result $Q/M_n$ and the detection result $Q/M_{n-1}$ previous to the newest detection result, the CPU 606 finds a prediction formula for the toner charge amount relative to time.

Figure 15:
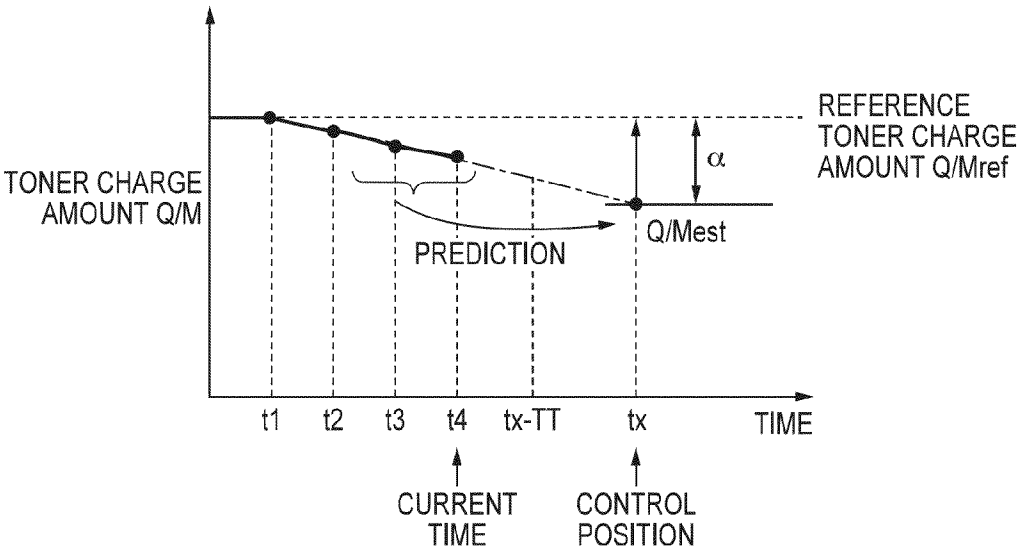
FIG. 15 is a diagram illustrating charge amounts and timings at which a γLUT is controlled, according to the third embodiment.

FIG. 15 is a diagram illustrating a relationship between a toner charge amount detection result and control timing according to the third embodiment. In the case where the CPU 606 calculates the prediction formula at time t4 in FIG. 15, the CPU 606 calculates the prediction formula for the toner charge amount based on a toner charge amount $Q/M_3$ and $Q/M_4$ at times t3 and t4 in FIG. 15 (S738). Formula (8) is obtained as the prediction formula.

$$Y = \frac{(Q/M_3 - Q/M_4)}{(t3 - t4)}tx + \frac{(Q/M_4 * t3 - Q/M_3 * t4)}{(t3 - t4)} \quad (8)$$

The CPU 606 substitutes a toner charge amount $Q/M_{est}$ shifted from the reference toner charge amount $Q/M_{ref}$ by an amount equivalent to the threshold α for a variable Y in Formula (8), and calculates a control timing tx (S739).

It is necessary for the CPU 606 to carry out tone control when the control timing tx is reached. Accordingly, taking into consideration the time Tetd from the exposure position to the developing position and the time Tp required to control the exposing conditions, the CPU 606 determines whether or not Formula (9) holds true (S740).

$$(tx-TT)<(tn+t1) \quad (9)$$

Here, TT represents a time obtained by adding Tetd and Tp.

In the case where Formula (9) does not hold true (S740: NO), the CPU 606 determines that the toner charge amount can be detected again before the control timing tx, and returns the process to S733. On the other hand, in the case where Formula (9) holds true (S740: YES), the CPU 606 corrects the γLUT by multiplying the γLUT by the coefficient k obtained from Formula (6), using the toner charge amount $Q/M_{est}$ (S741).

The CPU 606 records the corrected γLUT in a memory (S742), and carries out tone control for correcting the image signal using the γLUT (S743).

Then, the CPU 606 determines whether or not the image forming process has ended (development OFF) (S744). In the case where the developing apparatus 104 is developing an image based on the image data in S744 (S744: NO), the process returns to the toner charge amount measurement sequence in S733.

On the other hand, in the case where the developing apparatus 104 has finished developing the image based on the image data in S744 (S744: YES), the CPU 606 ends the process for correcting the γLUT.

The foregoing has described a method for carrying out tone control by predicting the toner charge amount. However, there is also a method in which the amount of error from the actual toner charge amount can be reduced even in the case where the measurement position and the control position differ, by changing the threshold in FIG. 10 from α to a more stringent condition β and carrying out finer control. Furthermore, although the present embodiment describes predicting the time using two points, the prediction may be carried out using three or more points.

According to the present embodiment, appropriate exposing conditions can be set before the toner charge amount fluctuates by greater than or equal to a predetermined value by predicting a timing at which the deviation of the toner charge amount will exceed the predetermined value.

Fourth Embodiment

The first embodiment describes a method in which one charge amount measurement unit 108, which includes the QCM sensor 120 as a toner charge amount measurement unit, is disposed at the measurement position shown in FIG. 3, and the charge amount of the toner on the developing sleeve 111 is detected. However, in the case where the toner charge amount varies along the axial direction of the developing sleeve 111 and the exposing conditions are controlled based on the toner charge amount detected at the single measurement position, it is possible that an image will be formed with the density thereof varying along the axial direction of the photosensitive drum 101. In other words, because only one QCM sensor 120 is disposed along the axial direction of the developing sleeve 111 in the first embodiment, unevenness in the toner charge amount along the axial direction of the developing sleeve 111 cannot be suppressed.

Accordingly, the fourth embodiment is configured so that at least two charge amount measurement units 108 are disposed along the axial direction of the developing sleeve 111. Furthermore, the configuration is such that a γLUT can be set for each detection position based on the toner charge amounts detected by the respective charge amount measurement units 108.

Figure 9:
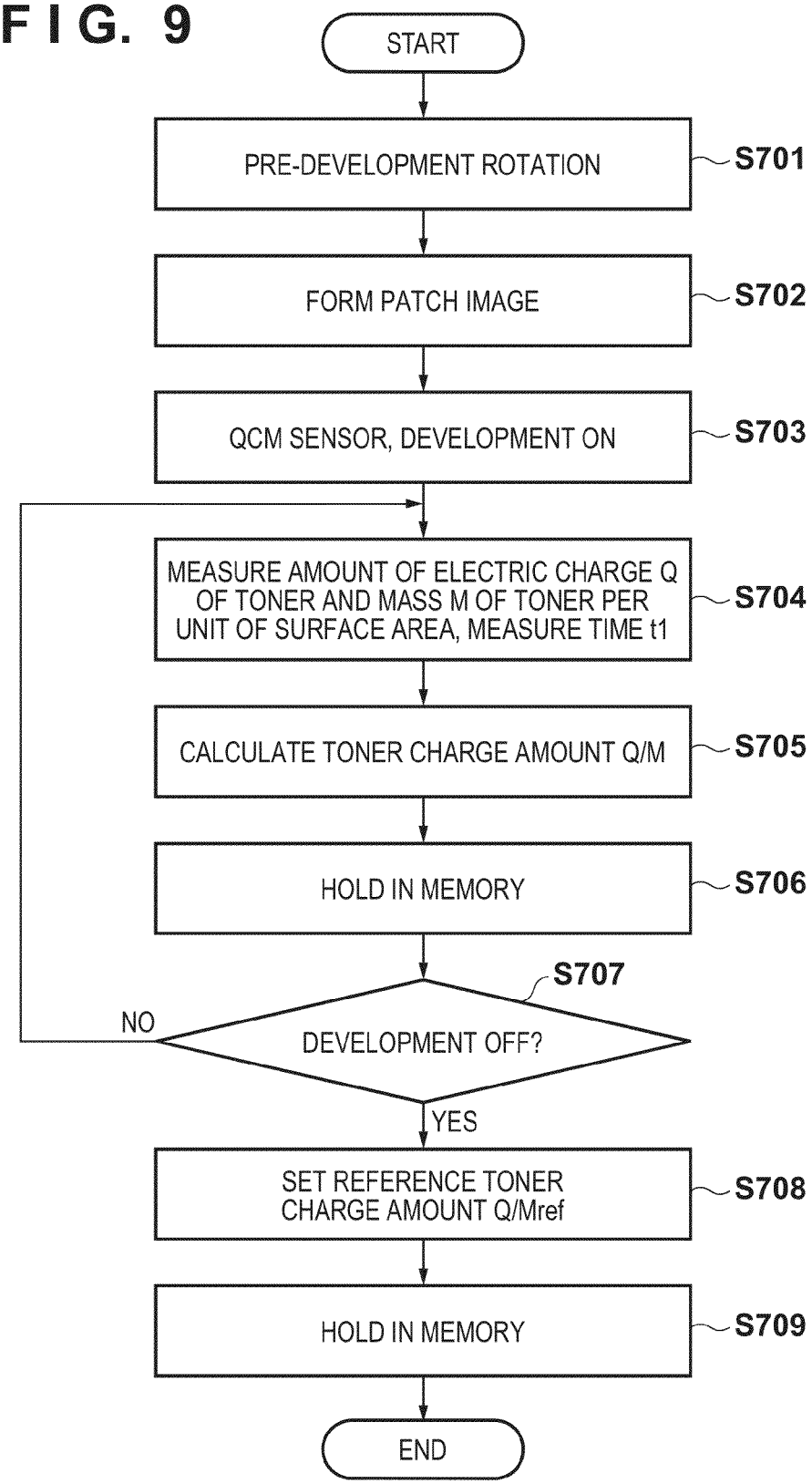
FIG. 9 is a flowchart illustrating a process for measuring a reference toner charge amount.
Figure 16:
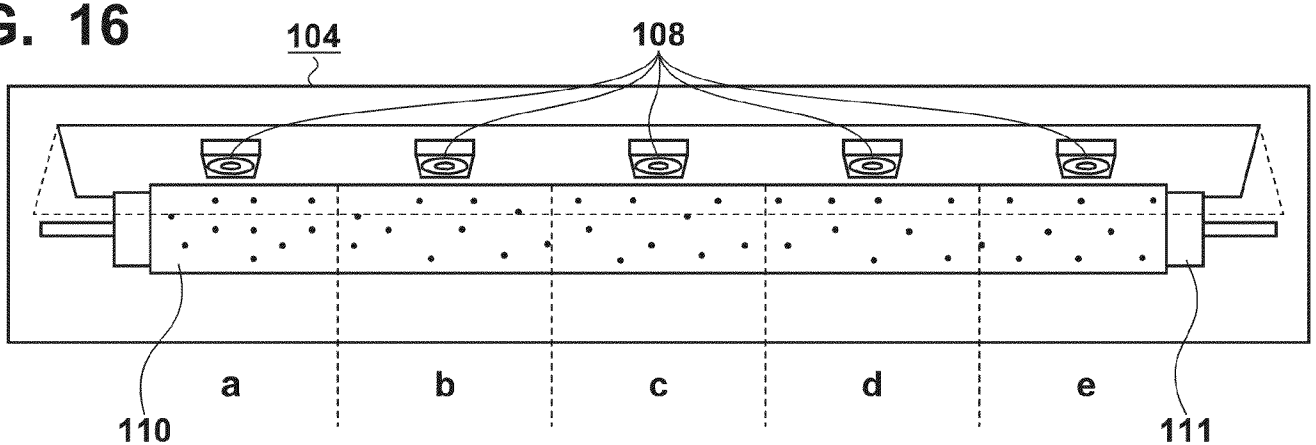
FIG. 16 is a schematic diagram illustrating the primary components of a developing apparatus according to a fourth embodiment.

FIG. 16 is a schematic diagram illustrating the primary components of the developing apparatus 104, viewed from the direction of the arrow A in FIG. 3. In FIG. 16, five charge amount measurement units 108, for example, are disposed along the axial direction of the developing sleeve 111. Each charge amount measurement unit 108 is driven independently. Areas (regions) are delineated in advance, as indicated by a to e in FIG. 16, based on the positions of the charge amount measurement units 108. The CPU 606 can set a γLUT for each of these areas. The reference γLUT is stored in advance, as described in the first embodiment. Note that the reference γLUT is common across all of the areas. Furthermore, the reference toner charge amount measurement process indicated in FIG. 9 is carried out for each area. The γLUT correction process is carried out independently for each area.

According to the present embodiment, at least two charge amount measurement units 108 are disposed along the axial direction of the developing sleeve 111, and tone control is carried out at each position thereof. Through this, even in the case where the toner charge amount varies along the axial direction of the developing sleeve 111, exposing conditions that suppress unevenness in the density along the axial direction of the developing sleeve 111 can be set.

Fifth Embodiment

The fourth embodiment is configured so that the same reference γLUT is held for a plurality of charge amount measurement units 108. Accordingly, in the case where, for example, a distance between the developing sleeve 111 and the photosensitive drum 101 varies along the axial direction of the developing sleeve 111, the density of the output image may become unstable even if tone control is carried out based on fluctuations in the toner charge amount Q/M.

Accordingly, a fifth embodiment is configured so that a patch image is formed on the photosensitive drum 101 using toner, at each area on the developing sleeve 111, whose charge amounts have been detected by the plurality of charge amount measurement units 108, and the optical sensor 607 detects the density of the patch image. An optical sensor 607 is disposed at each area, serving as a density detection unit that detects a density of the patch image (a measurement image) formed at each area. Then, a reference γLUT is created for each area based on the toner charge amount Q/M detected by the corresponding charge amount measurement unit 108 and the density of the patch image detected by the corresponding optical sensor 607, so as to suppress fluctuations in the image density caused by factors aside from variations in the toner charge amount Q/M.

Figure 17:
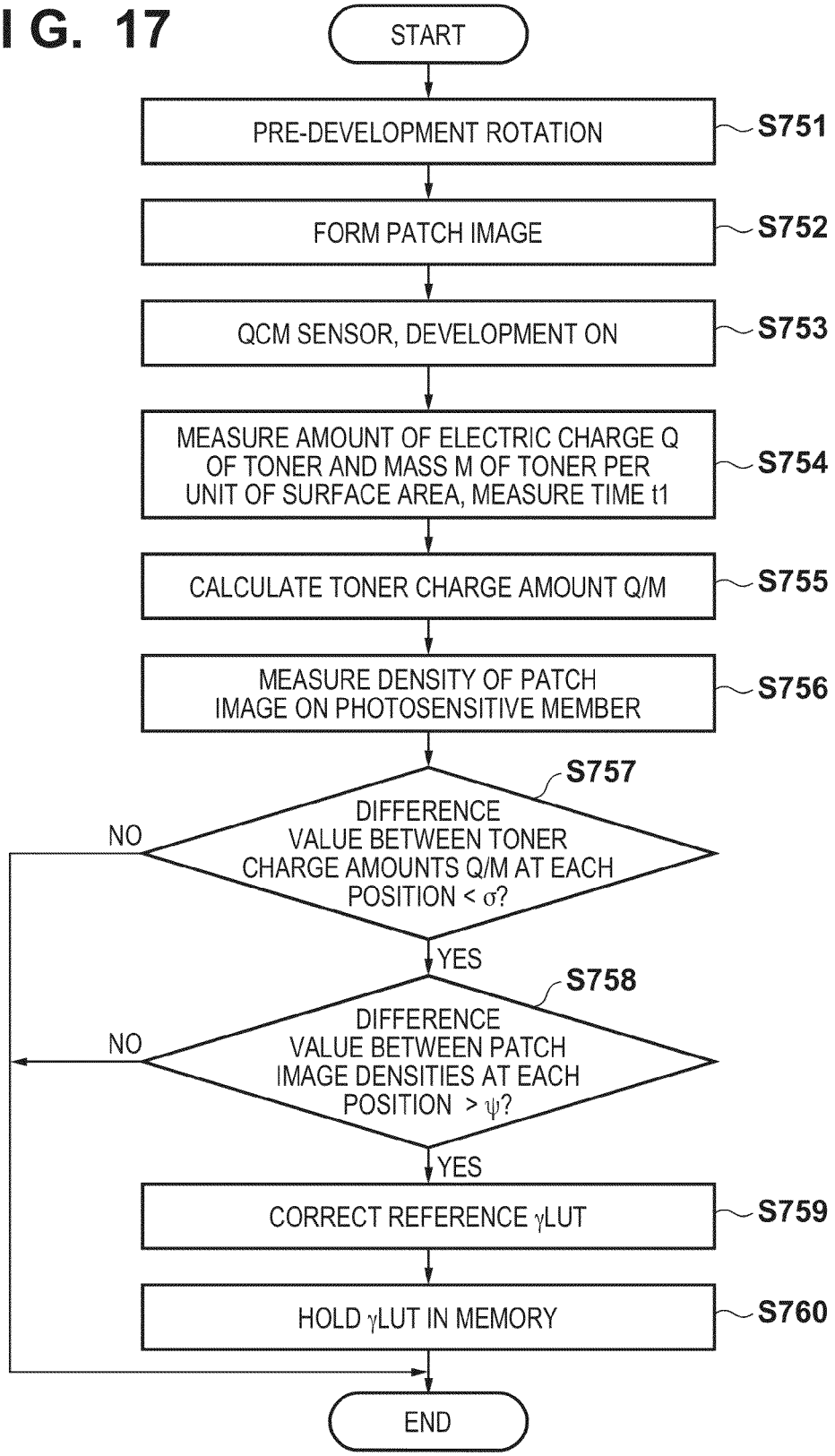
FIG. 17 is a flowchart illustrating a γLUT creation sequence according to a fifth embodiment.

FIG. 17 is a flowchart illustrating a γLUT creation sequence according to the fifth embodiment. Descriptions of configurations identical to those in the first embodiment will be omitted.

First, when the image forming apparatus 10 is turned on, the CPU 606 starts the rotational driving of the developing sleeve 111 and the agitating screw 118 in the developing apparatus 104 in order to increase the charge amount of the toner (S751).

Next, the CPU 606 causes the aforementioned patch image to be formed (S752), and starts the toner charge amount measurement sequence (FIG. 7) while the developing apparatus 104 is developing the patch image (S753).

The CPU 606 carries out the toner charge amount measurement sequence and calculates the amount of electric charge Q of the toner and the mass M of the toner, and measures the time to at which the toner charge amount measurement sequence was carried out (S754). The CPU 606 then calculates the toner charge amount Q/M from the amount of electric charge Q of the toner and the mass M of the toner (S755), and holds that value in a memory (S756). At this time, the density of the patch image on the photosensitive drum 101 is measured by the optical sensor 607. The optical sensor 607 employs a reflective optical sensor. However, the device for detecting the density of the patch image is not limited to such a sensor as long as it is capable of detecting an image density.

Next, the CPU 606 calculates a difference between the toner charge amounts Q/M measured by the plurality of charge amount measurement units 108 (a Q/M difference value), and determines whether or not each Q/M difference value is less than a threshold σ (S757). The threshold σ is set so that σ=1, for example. In the case where at least one of the Q/M difference values is greater than or equal to the threshold σ (S757: NO), the γLUT creation sequence is ended. On the other hand, in the case where any of the Q/M difference values is lower than the threshold σ (S757: YES), the CPU 606 advances the process to S758.

In S758, the CPU 606 calculates patch image density differences (density difference values) based on the density values of the patch image measured by the plurality of optical sensors 607, and determines whether or not each density difference value is greater than a threshold ψ. The threshold ψ is set so that ψ=0.1, for example. In the case where any of the density difference values is less than or equal to the threshold ψ (S758: NO), the γLUT creation sequence is ended. On the other hand, in the case where at least one of the density difference values is greater than the threshold ψ (S758: YES), the CPU 606 advances the process to S759.

In S759, the result of detecting the density of the patch image indicates fluctuations despite the toner charge amounts Q/M detected by each charge amount measurement unit 108 experiencing almost no change, and thus the CPU 606 determines that the density is fluctuating due to a factor aside from the toner charge amount Q/M. Accordingly, the CPU 606 sets the reference γLUT for each area (S759).

Thereafter, the CPU 606 holds the γLUTs set for each area in a memory (S760) and ends the γLUT creation sequence.

Effects of Fifth Embodiment

An LUT for outputting images at a stable image density is set for each of areas obtained by dividing a developer bearing member into a plurality of areas in the axial direction, and thus fluctuations in the image density can be suppressed even in the case where the image density has fluctuated due to a factor aside from the toner charge amount.

Other Embodiments

Embodiments of the present invention can also be realized by a computer of a system or apparatus that reads out and executes computer executable instructions recorded on a storage medium (e.g., non-transitory computer-readable storage medium) to perform the functions of the above-described embodiment of the present invention, and by a method performed by the computer of the system or apparatus by, for example, reading out and executing the computer executable instructions from the storage medium to perform the functions of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-089618, filed Apr. 22, 2013, which is hereby incorporated by reference herein in its entirety.

What is claimed is:

1. An image forming apparatus comprising:

a photosensitive member configured to rotate;

an exposure unit configured to expose the photosensitive member to form an electrostatic latent image on the photosensitive member;

a developing unit, including a developer bearing member configured to bear toner and rotate, configured to develop the electrostatic latent image on the photosensitive member using the toner borne by the developer bearing member;

a measuring unit, including an attracting unit configured to attract the toner on the developer bearing member, configured to measure a charge amount of the toner attracted to the attracting unit; and a control unit configured to control an exposing condition of the exposure unit, based on the charge amount measured by the measuring unit, wherein in the case where a time necessary for the developer bearing member to rotate from a measurement position where the attracting unit attracts the toner on the developer bearing member to a developing position at which the electrostatic latent image on the photosensitive member is developed by the toner on the developer bearing member is represented by a time Tqcm, a time necessary for the photosensitive member to rotate from an exposure position at which the exposure unit exposes the photosensitive member to the developing position is represented by a time Tetd, and a time necessary for the control unit to control the exposing condition based on the charge amount measured by the measuring unit is represented by a time Tp, the attracting unit is disposed so that $Tqcm \geq Tedt+Tp$ holds true.

2. The image forming apparatus according to claim 1, wherein the control unit is configured to set a timing for controlling the exposing condition based on the charge amount measured by the measuring unit and a target value of the toner charge amount.

3. The image forming apparatus according to claim 2, wherein the control unit is configured to control the exposing condition when a difference between the charge amount measured by the measuring unit and the target value of the toner charge amount exceeds a threshold.

4. The image forming apparatus according to claim 1, further comprising:

a storage unit configured to store the charge amount repeatedly measured by the measuring unit, wherein the control unit is configured to set a timing at which to control the exposing condition based on a plurality of measurement results stored in the storage unit.

5. The image forming apparatus according to claim 4, further comprising:

a determining unit configured to determine the timing at which the difference between the charge amount measured by the measuring unit and the target value of the toner charge amount will exceed the threshold based on the plurality of measurement results stored in the storage unit, wherein the control unit is configured to control the exposing condition when the timing determined by the determining unit is reached.

6. The image forming apparatus according to claim 1, wherein the measuring unit includes a plurality of attracting units that attract toner from different regions in the axial direction of the developer bearing member.

7. The image forming apparatus according to claim 6, wherein the control unit is configured to control the exposing condition based on charge amounts of the toner attracted by each of the plurality of attracting units.

8. The image forming apparatus according to claim 6, further comprising:

a density detection unit configured to detect the density of a measurement image formed on the photosensitive member using the toner borne by different areas in the axial direction of the developer bearing member, wherein the control unit is configured to control the exposing condition based on a detection result from the density detection unit and the charge amounts of the toner attracted by each of the plurality of attracting units.

9. The image forming apparatus according to claim 1, wherein the attracting unit includes a quartz chip configured to vibrate when a voltage is applied to the quartz chip, a first electrode provided on a first surface of the quartz chip, a second electrode provided on a second surface that is the opposite surface of the quartz chip from the first surface, a first measuring unit configured to measure a resonance frequency at which the quartz chip vibrates when a voltage is applied to the first electrode and the second electrode, and a second measuring unit configured to measure an amount of electric charge of the toner attracted to the first electrode, wherein the measuring unit is configured to measure the charge amount of the toner attracted to the attracting unit based on the resonance frequency measured by the first measuring unit and the amount of electric charge measured by the second measuring unit before the toner is attracted to the first electrode, and the resonance frequency measured by the first measuring unit and the amount of electric charge measured by the second measuring unit after the toner has been attracted to the first electrode.

10. The image forming apparatus according to claim 1, wherein the exposing condition is a timing at which laser light emitted from the exposure unit to expose the photosensitive member flashes.

* * * * *